US007059248B2

(12) United States Patent
Vaidyanathan et al.

(10) Patent No.: US 7,059,248 B2
(45) Date of Patent: Jun. 13, 2006

(54) DIGITAL SEMICONDUCTOR BASED PRINTING SYSTEM AND METHOD

(76) Inventors: Nandakumar Vaidyanathan, 16522 Hillview Cir., Huntington Beach, CA (US) 92648; Ravi Subrahmanyan, 7 Balmorra Rd, Windham, NH (US) 03087

( * ) Notice: Subject to any disclaimer, the term of this patent is extended or adjusted under 35 U.S.C. 154(b) by 0 days.

(21) Appl. No.: 10/956,416

(22) Filed: Oct. 1, 2004

(65) Prior Publication Data

US 2005/0155508 A1 Jul. 21, 2005

Related U.S. Application Data

(63) Continuation-in-part of application No. 10/759,765, filed on Jan. 16, 2004, now abandoned.

(51) Int. Cl.
*B41M 1/42* (2006.01)

(52) U.S. Cl. ..... 101/489; 101/401; 347/111; 347/112

(58) Field of Classification Search ..... 101/489, 101/401; 347/111, 112, 141, 142
See application file for complete search history.

(56) References Cited

U.S. PATENT DOCUMENTS

| | | | | |
|---|---|---|---|---|
| 5,109,240 | A * | 4/1992 | Engl et al. | 347/111 |
| 6,422,687 | B1 * | 7/2002 | Jacobson | 347/55 |
| 2004/0054031 | A1 * | 3/2004 | Jacobson | 523/160 |

* cited by examiner

*Primary Examiner*—Minh Chau
(74) *Attorney, Agent, or Firm*—Thomas P. Grodt

(57) ABSTRACT

A print engine suitable for printing barcodes and other patterns using charged inks includes a semiconductor memory layer having memory circuits that are coupled to one or more line elements and/or printel cells. The printel cells and line elements either attract or do not attract charged ink based on the data stored in the corresponding memory circuit. The line elements and printel cells may be configured to form a linear barcode or a 2-dimensional barcode. The charged ink may also be electrically conducting and the line elements and printel cells may be configured to form electrical structures such as electrical circuits or antennae. The charged ink may also be electrically semiconducting and by the line elements and printel cells may be configured to form electronic semiconductor devices and circuits.

38 Claims, 16 Drawing Sheets

FIG. 1a
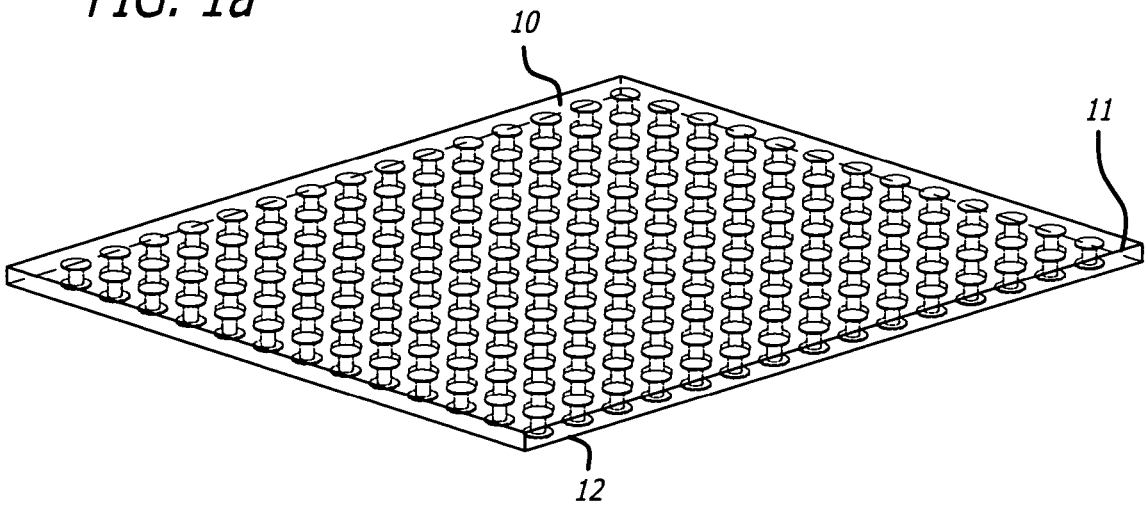
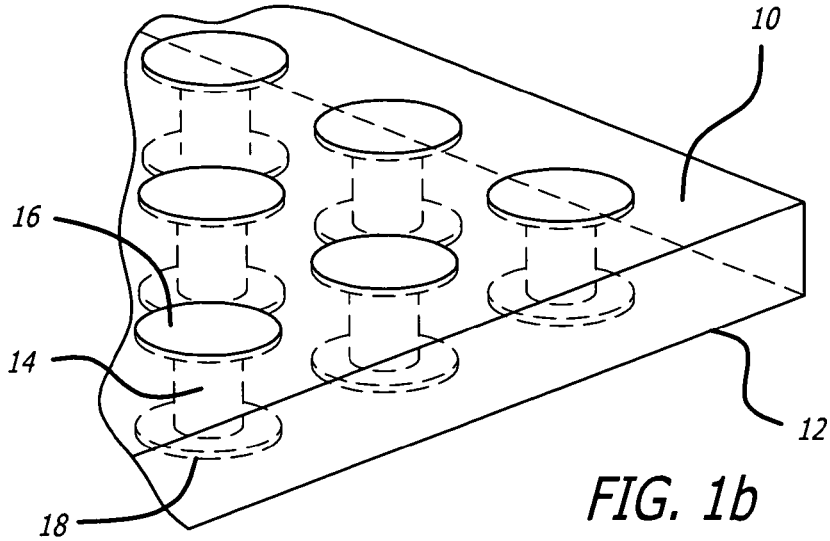
FIG. 1b

FIG. 2a
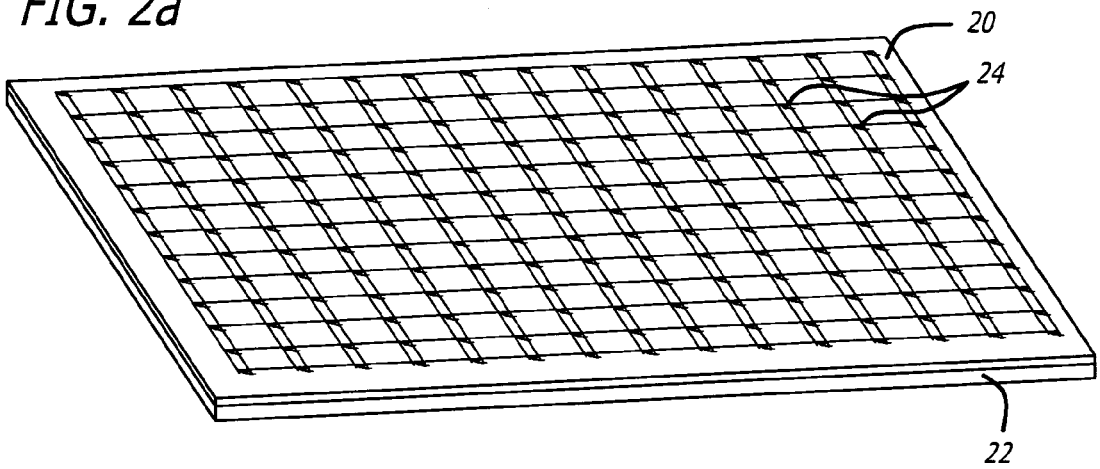
FIG. 2b
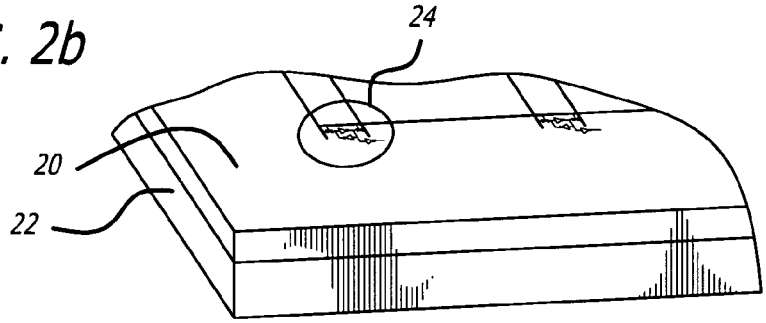
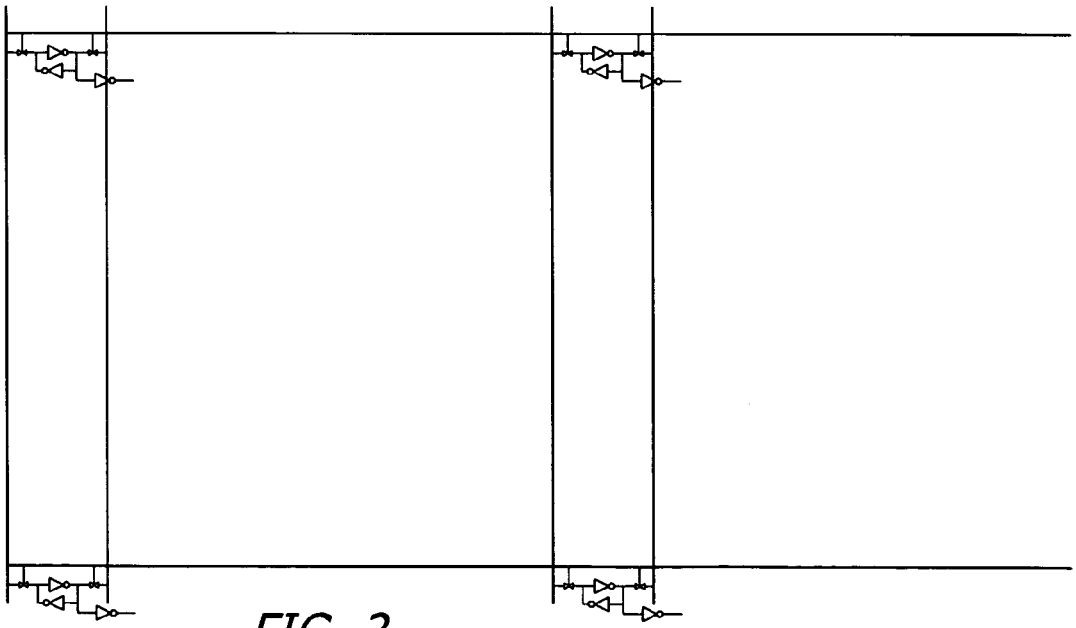
FIG. 3

FIG. 4a
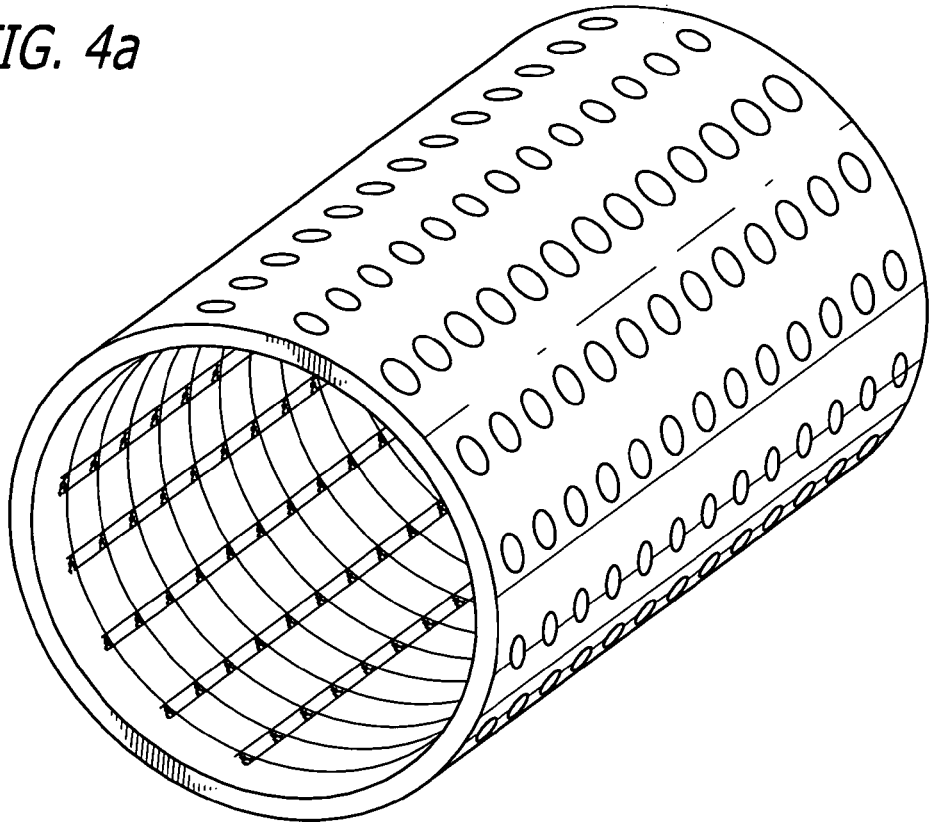
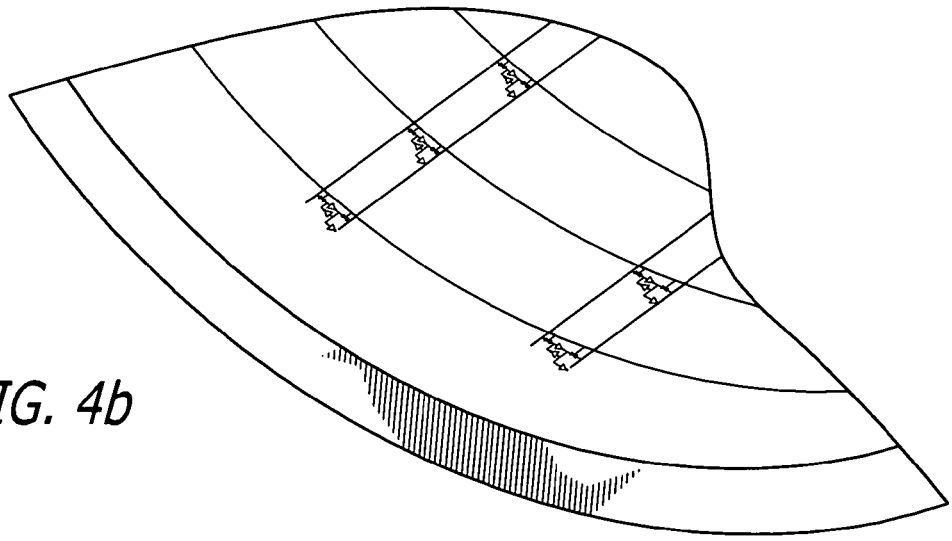
FIG. 4b

FIG. 9a
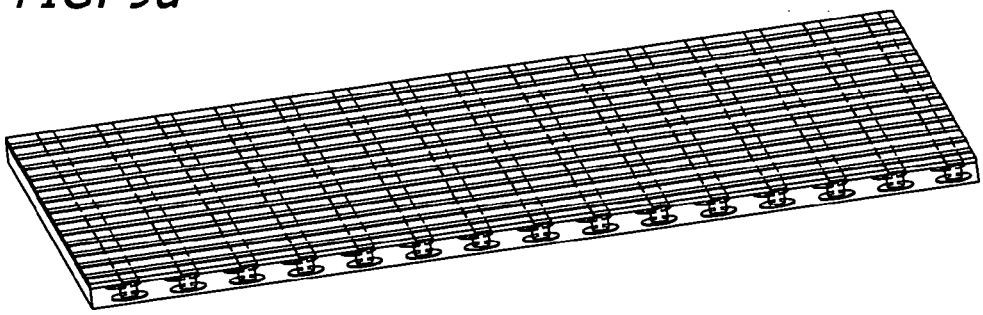
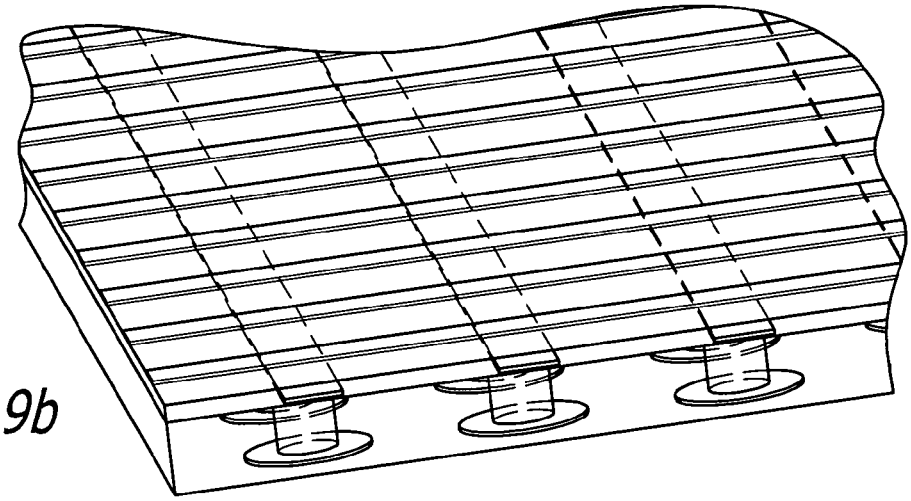
FIG. 9b
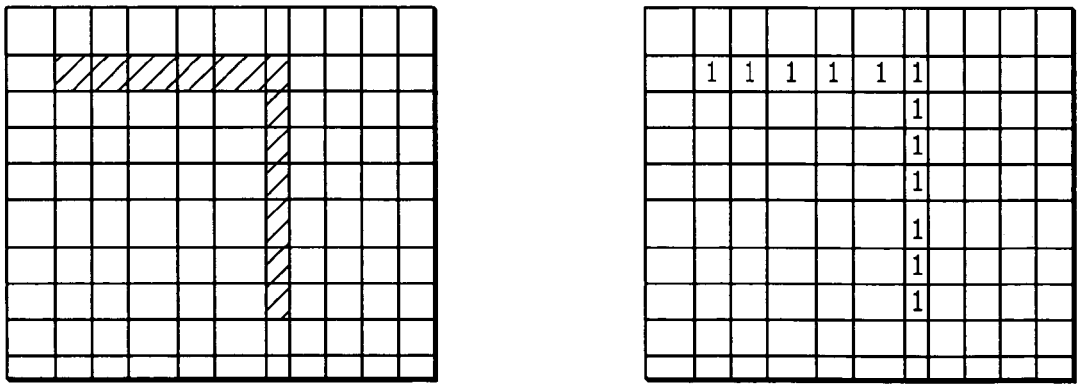
FIG. 10

FIG. 13
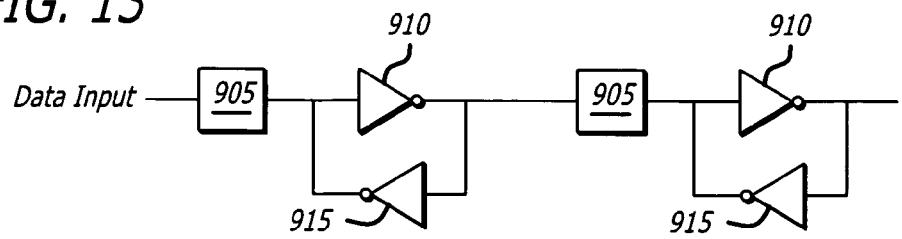
FIG. 14
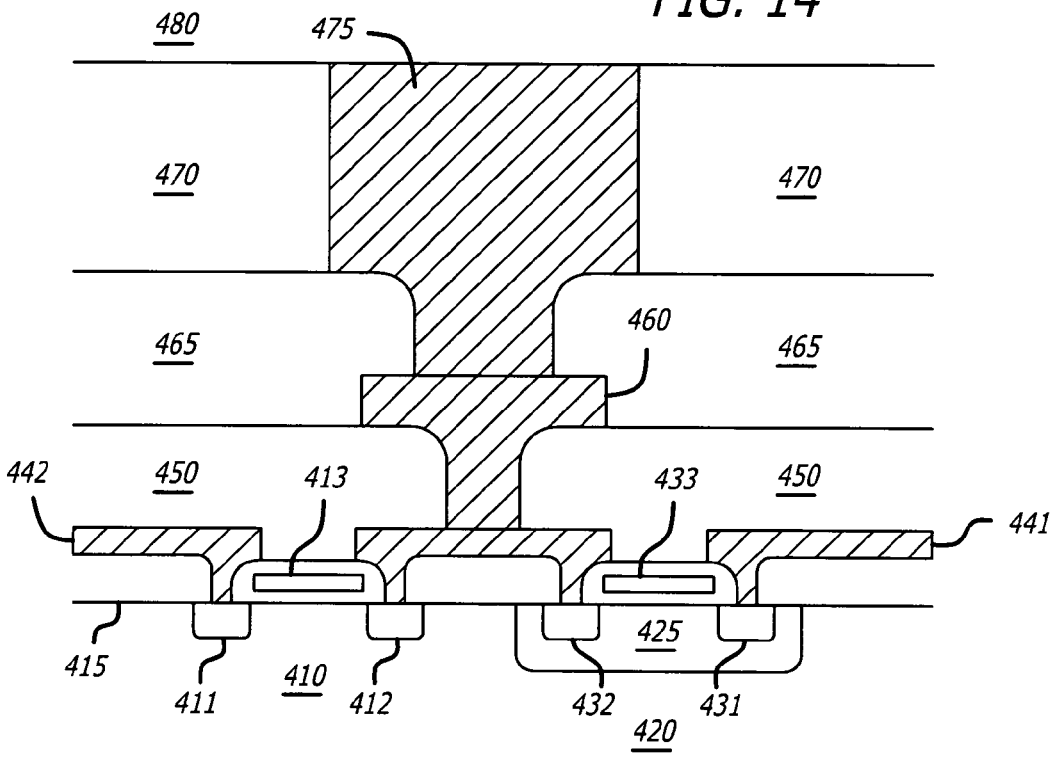
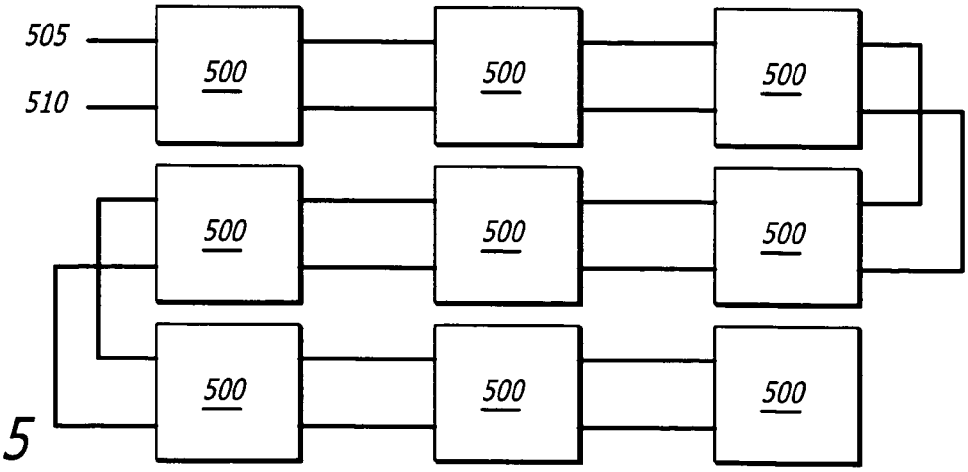
FIG. 15

DIGITAL SEMICONDUCTOR BASED PRINTING SYSTEM AND METHOD

This application claims priority to the prior patent application entitled, DIGITAL SEMICONDUCTOR BASED PRINTING SYSTEM AND METHOD, having a Serial number of Ser. No. 10/759,765 and that was filed in the United States Patent and Trademark Office on Jan. 16, 2004 now abandoned.

BACKGROUND

1. Field of the Invention

The present invention generally relates to semiconductor techniques for printing.

2. General Background and State of the Art

There are currently several dominant techniques used in computer based and commercial printing (non-impact printing).

A large portion of Personal Computer (PC) based printing is based on Ink Jet technology, or "Drop on Demand" methods where the image to be printed is constructed on an appropriate printing medium such as paper, plastic, textiles, printing plates and even silicon based substrates using print heads which eject drops of ink at the appropriate location on the printing medium. Since the ejection of ink occurs at the time the image is being printed this is often called "Drop on Demand" printing. The ink ejection mechanism may be controlled using piezo electric mechanisms or thermal mechanisms (ink jet or bubble jet). These printing methods rely on electronics that reside on the computer and on the printing equipment to deposit the ink on the printing medium. Since the entire image is constructed on a drop-by-drop basis, this can be a rather slow process.

Another kind of commercial printing that is carried out using the ink-jetting technique is called the Continuous Ink-Jetting Method. In this method, a continuous jet of ink is squirted through space, and using electrostatic deflector plates, the ink is selectively directed at the appropriate medium through a mesh, leading to deposition of dots to create patterns. The unused ink is directed through another channel and is recycled. This is the basis of the Continuous Ink Jetting technique and this process uses both charged and uncharged inks.

Another popular PC based printing method is "Laser Jet" or "Laser Writing" which is based on electrophotography. This method originated from Xerographic techniques for replication of images. In the original xerographic technique, a charged drum (photoconductive drum) is optically exposed to the image to be duplicated. Based on the image, charges are removed on the photoconductive drum using either a laser beam, or any other light source of appropriate spectral content and energy such as light emitting diodes (LED's). Specially charged ink, called toners, which could be either a fine powder or a liquid, are attracted to the locations on the photoconductive drum, which have the opposite electrical polarity. From the photoconductive drum, these charged particles are then transferred to the printing medium. In this method of printing, the contents of the entire image can be transferred to a photoconductive drum, and then the transfer effected to the printing media in a single step. This method of image transfer is therefore faster than the "Drop on Demand" technique previously described.

Another printing technology used in the commercial printing world, called magnetography, is similar to electrophotography, but uses magnetic fields instead of electrostatic fields to propel charges.

Perhaps the most dominant technology in the commercial printing world is based on lithography. Lithography involves a plate or an intermediate medium, on which the image to be printed is either exposed or engraved using a variety of techniques such as photography, laser ablation, thermal ablation and more recently ink jet based techniques. The areas of the printing plate have areas which accept ink (olephilic—oil loving) and areas, which accept water (hydrophilic). In general, the oil loving areas of the image do not accept water and the water loving areas do not accept ink. As the lithographic printing ink is an emulsion of pigments and water, the ink and water selectively migrate to their respective locations on the printing plates. Once the ink and water have migrated to their respective locations, it is then transferred to the medium being printed or to an intermediate cylinder called an offset cylinder and from the offset cylinder the image is deposited on the final medium.

There are four other processes, namely flexography, gravure, letterpress and screen printing.

The above-mentioned technologies are fairly well established. They have great advantages in their respective niches. However, there are significant disadvantages with each of the methods.

For example, as previously mentioned, ink jet based printers are quite slow. There are high costs associated with electrostatic printing processes for commercial printing, due to low throughput and inability to provide more than a certain number of copies (40,000 copies with current technology) on an electro-photography based machine, before the photoconductor drum is rendered useless for any other more reproduction. In lithographic printing, primary costs include use of expensive printing plates or spools, and high costs for recycling and disposal of environmentally unfriendly chemicals. Furthermore, the imaging or pre-imaging equipment used in the commercial printing world can be quite large and bulky.

Most commercial printing technology also involves disposable pieces. For example, lithographic printing involves using a new printing plate for every image printed. There are also inks that need to be poured and replenished, if one wants to make a large number (many thousands) of copies. With xerography, a new printing plate is not used each time. However, the same large number of copies cannot be made because the charges wear off and need to be replenished. In addition, the photoconductive drums lose sensitivity to spectral content after multiple usage.

Finally, personal printers such as inkjet and laser printers utilize ink cartridges, which need to be replaced on a regular basis. Much of the money made in the personal printing market is by consumables such as ink cartridges, toner, drums, and printing plates.

Automatic identification and data collection (AIDC), which is also known as Auto ID or Keyless Data Entry, is a generic term for various technologies that help reduce the time and labor of entering data by replacing manual methods of data entry and data collection with more automated methods. Barcodes can provide AIDC for a variety of products and in a variety of ways. Bar codes, such as the familiar Universal Product Code (UPC) symbol used on almost all packaged goods that are commercially sold, were first utilized in the early 1970s to help businesses maintain inventory control and to collect data on the products sold. Today, barcodes may be used to identify shipped packages to maintain accurate tracking and delivery information, to encode the serial numbers of a company's capital equipment, or to identify materials or products on a factory floor for proper routing.

Bar codes can be accessed at high speeds using optical techniques such as laser scanning. Due to the high speed with which data may be entered and collected, barcodes allow instantaneous, real-time data capture and exchange. Bar codes are also highly accurate with some studies suggesting that barcode scanning is more than 30000 times more accurate than manual data entry.

Aided by new technologies such as mobile and wireless printing, bar coding has evolved into a productivity enhancement tool widely used by business and industry for collecting and processing information. Bar codes encode data—such as part number, serial number, supplier number, quantity, or transaction code—into the form of black and white stripes or "bars." A number of bar code standards have been developed and refined over the years into accepted languages called "symbologies".

Bar code symbologies can be either linear or two-dimensional. A linear bar code symbology consists of a single row of dark lines consisting of plurality of alternating lines that vary in thickness and separation. Usually there is a numerical code disposed beneath the plurality of alternating lines. The linear barcode is scanned and read by a laser and the barcode is stored in a memory device.

The newer 2-dimensional barcode is a 2-dimensional "stack" of barcode information. By increasing the number of dimensions that contain data, more information may be stored in a given area. 2-dimensional barcodes typically are configured either as stacked linear bar codes, or as matrix symbols that use regularly shaped black or white cells to encode data.

Barcodes data typically is either fixed or variable. Fixed data is defined as when the same barcode is printed on the same product in a repetitive manner. For example a can of soda, a magazine, or a newspaper will always have the same barcode as the product that is associated with the barcode does not change. Variable barcodes are used, for example, to track packages during shipping, to identify lots of raw materials that are used on a production floor, or to track components, such as silicon wafers, as they are moved throughout a factory.

A major disadvantage to barcodes is that it is an optically based identification system. Accordingly, an optical scanning device must have a clear line-of-sight to the physical barcode in order to accurately scan and read it.

The problems described above with respect to other forms of printing are also associated with barcodes. Of the various types of printing used for barcodes, the most common is thermal ink printing. As discussed above, thermal printing can be rather slow and also expensive due to the consumables required.

Another technology used for AIDC is radio frequency identification (RFID). RFID systems consist of a reader, also called an interrogator and a tag, also called a transponder. RFID tags typically include an integrated circuit, an antenna, an electrical connection between the integrated circuit and the antenna, and a substrate. The antenna is a conductive element that has a specific configuration depending upon the particular application. Typically, the RFID tag antenna is made using 30 μm wire coiled and spot welded directly to the substrate. Although this method works for small production volumes with few cost constraints, this method of constructing RFID tags does not scale to larger production runs and is too expensive for large throughputs.

SUMMARY

The printing system and method described herein includes a print element having at least one conductive element that is electrically coupled to a memory circuit. The memory circuit can be switched between a first state and a second state such that the conductive element has a state that corresponds to that of the associated memory circuit. When the conductive element is in the first state it attracts the charged ink and when it is in the second state the conductive element does not attract the charged ink. Thus, printing, i.e., the deposit of ink, will occur only where the charged ink has accumulated on conductive elements having the first state and no printing, or white space, will occur where the conductive element has not attracted the charged ink.

The conductive elements, may be a metallic conductor, such as gold, silver, copper or aluminum, or a other conductive material, or a semiconductor material. In one embodiment, the conductive elements are formed as line elements and may be placed parallel to one another forming a linear barcode.

The conductive elements may also be printel cells, where each printel cell represents a single location within an image to be printed. Each printel cells is coupled to a memory circuit that can be switched between a first and second state, wherein the printel cell has a state that corresponds to the state of the memory circuit. When the printel cell is in the first state it attracts the charged ink and when it is in the second state the conductive element does not attract the charged ink. A plurality of printel cells may be placed together in a grid pattern in order to form alphanumeric or other symbols. This grid may be placed beneath the plurality of line elements to form the numeric portion of a barcode. Alternatively, the grid of printel cells may be placed between two or more line elements to form a 2-dimensional barcode.

In another embodiment, the charged ink may be electrically nonconductive, an electrical semiconductor, or an electrical conductor. When an electrically conductive charged ink is used, the printing system and method described herein may be used to form patterns of electrical conductors on a substrate. This is useful, for example, when forming antennas for radio frequency identification (RFID) tags.

In one embodiment, the charged ink is positively charged and may include pigments of a desired color to form a colored ink that may be black or part of a desired color scheme. In another embodiment, the charged ink is negatively charged and may include pigments of a desired color to form a colored ink that may be black or part of a desired color scheme.

Additional features and advantages will be set forth in the description which follows, and in part will be apparent from the description, or may be learned by practice of the disclosed printing system. The objectives and other advantages of the printing system will be realized and attained by the structure particularly pointed out in the written description and claims hereof as well as the appended drawings.

BRIEF DESCRIPTION OF THE DRAWINGS

The accompanying drawings, which are included to provide a further understanding of the printing system and are incorporated in and constitute a part of this specification, illustrate embodiments of the system and together with the description serve to explain the principles of at least one embodiment of the invention.

FIGS. 1*a*–1*b* show an insulated conductive layer or medium in a flat configuration.

FIGS. 2*a*–2*b* show how the memory layer is superimposed on the insulated conductive layer.

FIG. 3 shows an enlarged view of a memory cell.

FIGS. 4*a*–4*b* show memory cells overlaid on the insulated conductive layer for a cylindrical configuration of the print engine.

FIGS. 9*a*–9*b* show an alternative embodiment of the present invention utilizing organic polymers to form memory.

FIG. 10 shows how an image can be mapped onto memory locations.

FIG. 13 shows an exemplary single ended storage cell.

FIG. 14 is a cross sectional view of a semiconductor layout showing how a micro-via may be used to connect the transistors of a memory element to the surface of the chip.

FIG. 15 shows how an array of chips can be connected to create a large array.

DETAILED DESCRIPTION

Figure 1C:
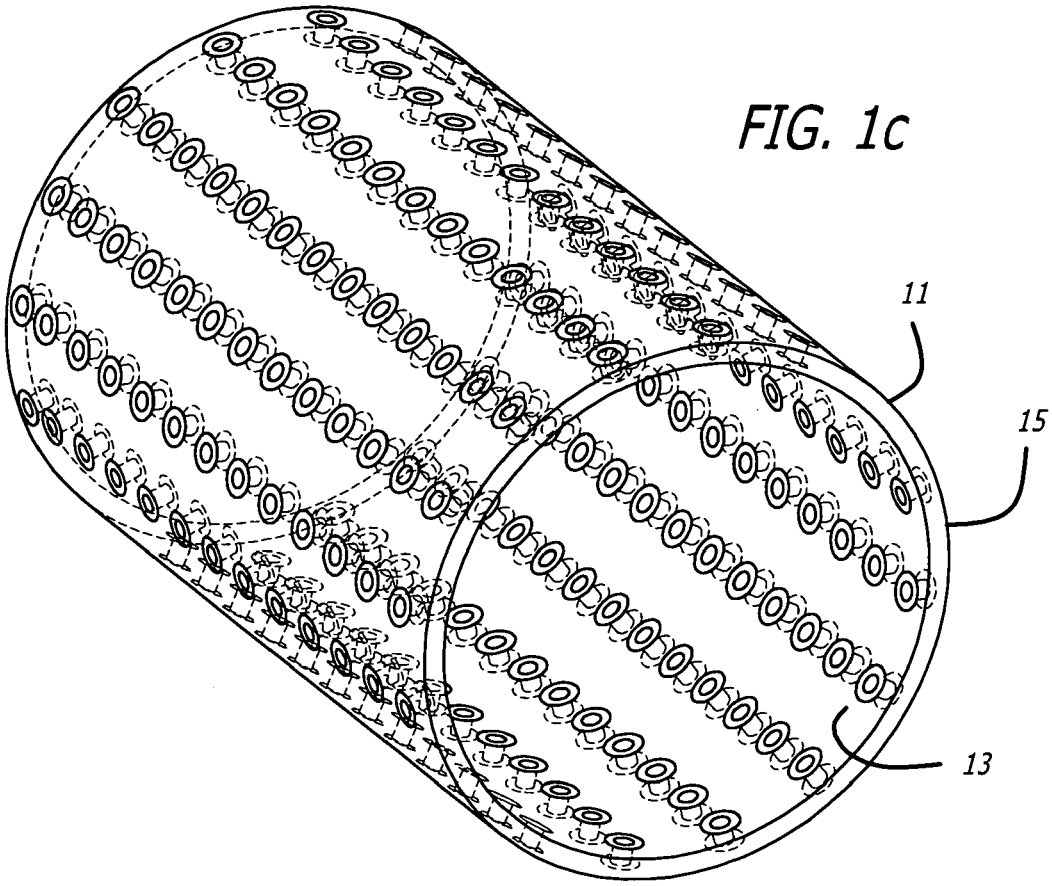
FIGS. 1*c*–1*d* show an insulated conductive layer or medium in a cylindrical configuration.

Reference will now be made in detail to the preferred embodiments of the printing system, examples of which are illustrated in the accompanying drawings.

An electronic stored image based scheme is proposed which permits the digital printing elements to print a digitally stored image onto any medium. This is accomplished by using a semiconductor memory-based scheme in which an image is stored in an electronic memory with each digital printing element occupying one memory location. Since information is stored in memory as a voltage, by directly coupling the memory location to a conductive element, the stored voltage can be used to directly control whether or not conductive toner based inks are attracted to that conductive element.

The system provides for a printing drum comprising a semiconductor memory. The semiconductor memory uses decoding elements to allow access to each of many storage locations without requiring an individual connection to each location. The system therefore utilizes the semiconductor memory structure to spatially map a digitally stored bit of data (e.g., 0 or 1) to a physical location.

In another embodiment, the semiconductor printing system can also be composed of a flat semiconductor memory panel, over which a system of charged and uncharged rollers can translate successively, and selectively transfer charged ink (toner) to and from the semiconductor memory panel to a printing medium.

As all printed images are generally composed of dots of ink at a specific location on a medium, it is possible to translate the specific location to where the ink can be transferred to a memory cell in a chip, and from the memory cell to the final printing medium. It is therefore possible to "load" an image efficiently over a bus or communication channel. Once the image is loaded into the memory, the conductive locations associated with each printing element receive the appropriate voltage and the image can be formed on any printing media. After a desired number of images have been printed, a new image can be downloaded and a new image can be printed. This is the basic principle of the print engine in accordance with the present invention.

The digital printing engine uses low voltage electrostatics to direct toners or other conductive printing inks to its surface. This print engine does not have any intervening consumable media such as a printing plate.

Print Engine Construction

The print engine of the disclosed embodiment comprises an insulated conductive layer and a semiconductor memory layer.

FIG. 1*a* shows an insulated conductive layer in a flat configuration. FIG. 1*b* is an enlarged view of the insulated conductive layer of FIG. 1*a*.

The insulated conductive layer comprises an insulating medium 11 having a top surface 10 and a bottom surface 12, a plurality of micro-vias 14 that connect the top and bottom surfaces of the insulator, conductive pads 16 on the top, and conductive pads 18 on the bottom surfaces of the insulator.

The insulating medium can be either flexible or rigid. Typical choices for the insulating medium include, but are not limited to: plastics such as nylon, delrin, ABS, ceramics or even metals such as aluminum or steel that can be cladded by a polymeric or ceramic insulating layer. The choice of the insulator depends on the application. The insulating medium has very small holes (approximately 20 microns in diameter) drilled through its thickness. The number of micro holes are determined by the dots per inch of printing tat is required from the specific printing application.

The micro-vias 14 are through holes filled with a conductor. These holes can be drilled using excimer lasers or by chemical means. As future technologies become available, other machining methods can be used to drill these through holes, or micro vias 14. The micro-vias 14 are filled with an appropriate conductor such as copper or silver or gold, or any appropriately solidifying conductive paste, and they terminate at both the top 10 and bottom 12 surfaces with contact pads 16 and 18.

The contact pads 16 and 18 can be circular or rectangular in shape. Thus the contact pads 16 and 18 help electrically connect the top and the bottom surface of the insulated conductor. The thickness of the insulating medium is determined by whether the insulator is used as a rigid medium or as a flexible medium. In some cases, the insulating conducting pad can be made flexible and can be superimposed on a rigid flat plate and thus have a higher flexural rigidity. Typical thickness of the insulated medium can range from a few thousand micro inches to a few inches. The insulated medium can be either flexible or rigid. Both flat and cylindrical geometries are possible in the flexible or rigid configuration. The type of application, namely flexible or rigid configuration, determines the thickness of the insulated conductive layer.

Figure 1D:
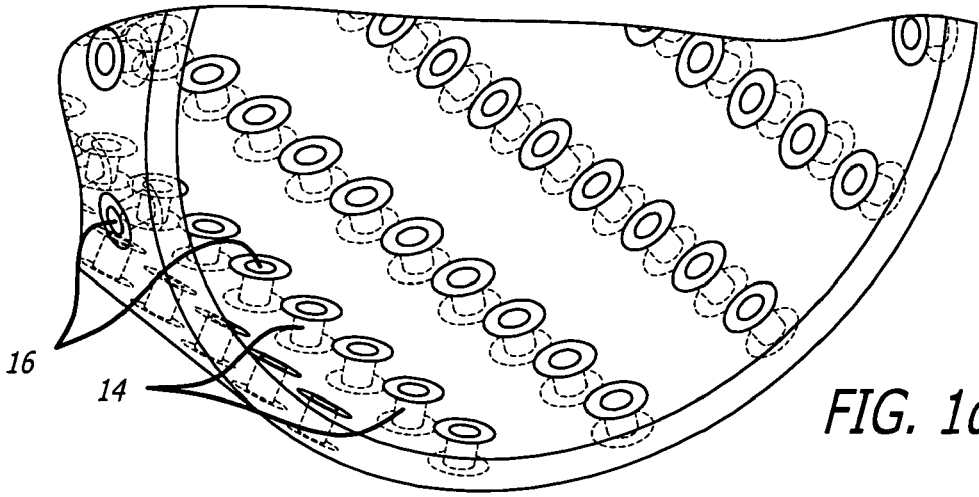

FIGS. 1*c*–1*d* illustrate an insulated conductive layer in a cylindrical configuration. The cylindrical configuration has an inner surface 13 and an outer surface 15, with micro-vias 14 and contact pads 16 and 18 at the end of each micro-via, at the inner 13 and outer 15 surface.

Semiconductor Memory Structure

The semiconductor memory layer contains the "brains" of the printing engine. Memory can be manufactured using several different technologies, such as conventional silicon based semiconductors, organic semiconductors that use organic materials for semi-conducting purposes, or magneto-electronic materials that can be fashioned into memory cells. The print engine construction based on conventional silicon based semiconductors and organic semiconductors are now described.

FIGS. 2*a*–2*b* illustrate a typical memory layer 20 as it is superimposed on the insulated conductive layer 22. The memory layer 20 is generally made up of an array of individual memory cells 24. Memory is made of transistors and can be directly patterned over the insulated conducting layer as shown in FIGS. 1*a* and 1*c*, using different techniques. Memory can be made using traditional silicon wafer based semiconductors or organic semiconductors which have recently been developed.

FIG. 3 shows an enlarged view of a memory cell. In FIG. 3, an asymmetrically conductive adhesive (also known as anisotropic conductive adhesive) is used to couple the memory cell layer to the conductive pads on the insulated conductive layer.

FIGS. 4*a*–4*b* show memory cells overlaid on the insulated conductive layer for a cylindrical configuration of the print engine. The inner contact pads are in conformal contact with the asymmetrically conductive adhesive and are not visible in this picture. FIG. 4*b* is an enlarged view of the cylindrical configuration of the print engine.

Figure 5:
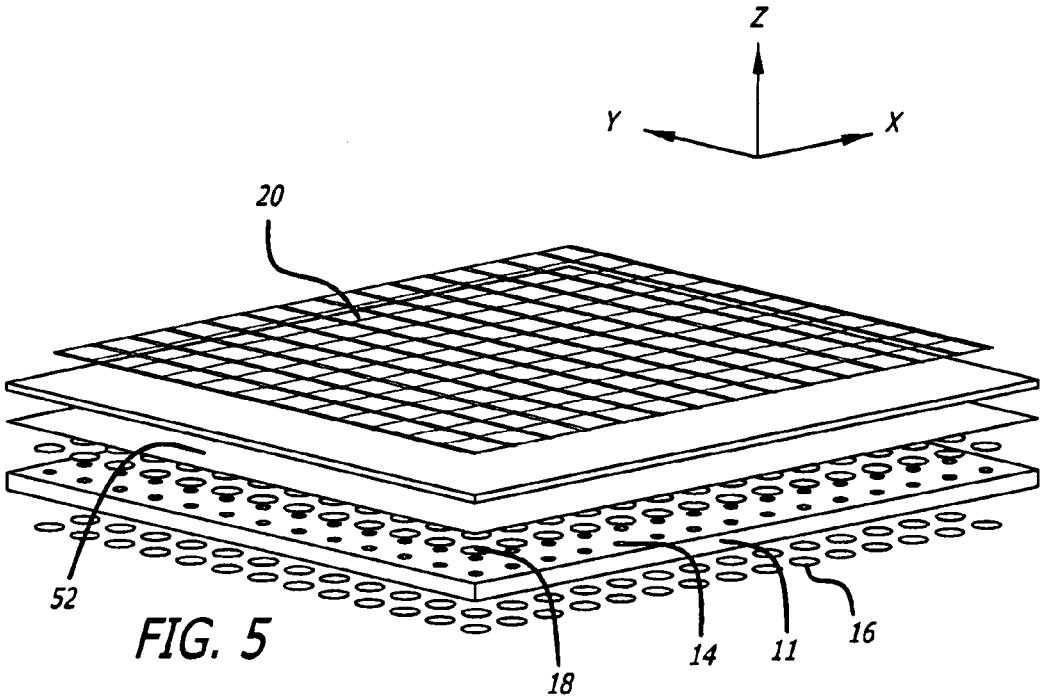
FIG. 5 shows an exploded view of how the different layers of the Print Engine are assembled.

FIG. 5 shows an exploded view of how the different layers of the Print Engine are assembled. The anisotropic conductive adhesive (ACA) binds the based memory layer to the insulated conductive layer, and using alignment marks during the assembly process, the individual memory cells are coupled to the contact pads on the insulated conductive layer, thus forming a single monolithic semiconductor based structure that can receive and store printing information.

Figure 6:
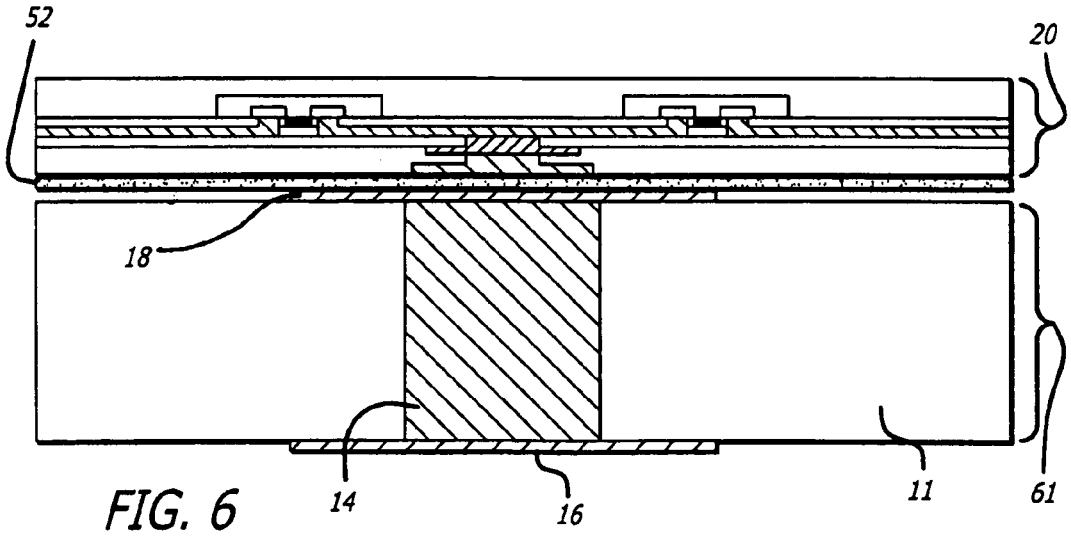
FIG. 6 shows the cross sectional view of a single memory cell coupled to a single conductive pad.

FIG. 6 shows the cross sectional view of a single memory cell coupled to a single conductive pad. The insulated conductive layer 61 is shown with micro-via 14 and top and bottom conductive pads 16 and 18. The insulated conductive layer is coupled to memory layer 20 using an asymmetrically conductive adhesive 52. FIGS. 2*a* through 6 show a flexible memory structure coupled to an insulated conductive layer with conductive pads.

Figure 7A:
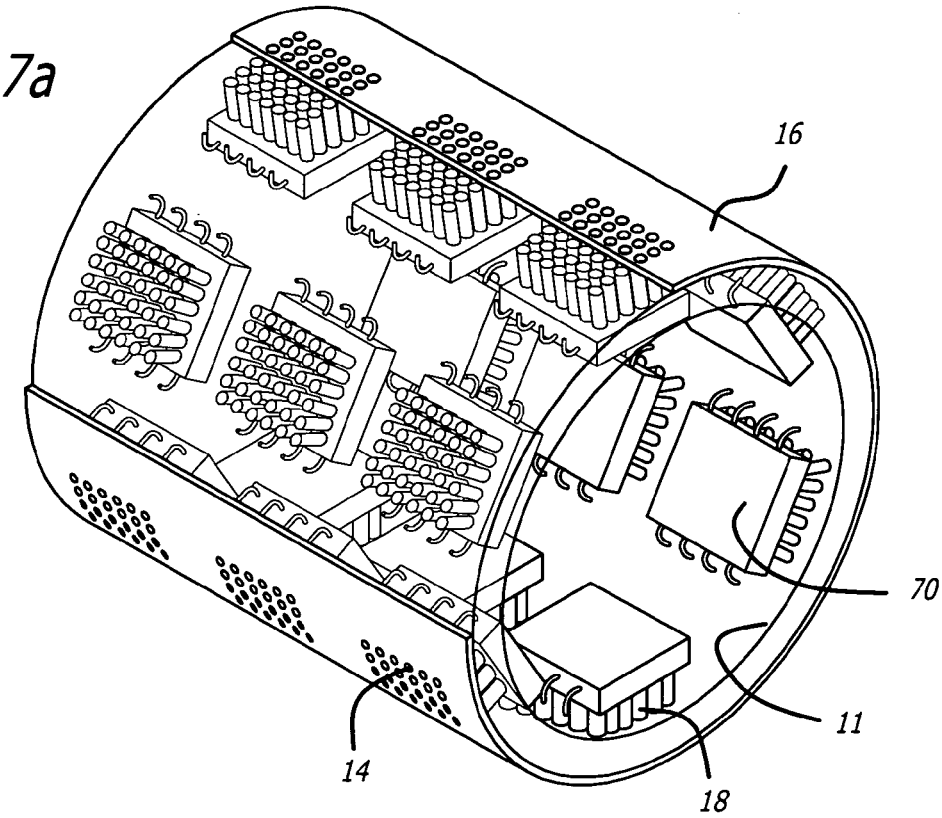
FIGS. 7*a*–7*b* show a cutaway and top views of an insulated conductive layer (and memory layer)/ the print engine.

FIG. 7*a* shows a cutaway view of an insulated conductive layer containing micro-vias in a cylindrical configuration, coupled to packaged integrated memory chips. Part of the insulated conductive layer has been removed to show the asymmetrically conductive adhesive layer, and the location of the integrated memory chips. In this embodiment, the memory locations in the packaged integrated memory chips are directly coupled to the conductive pads on the cylinder using asymmetrically conductive adhesives.

Figure 7B:
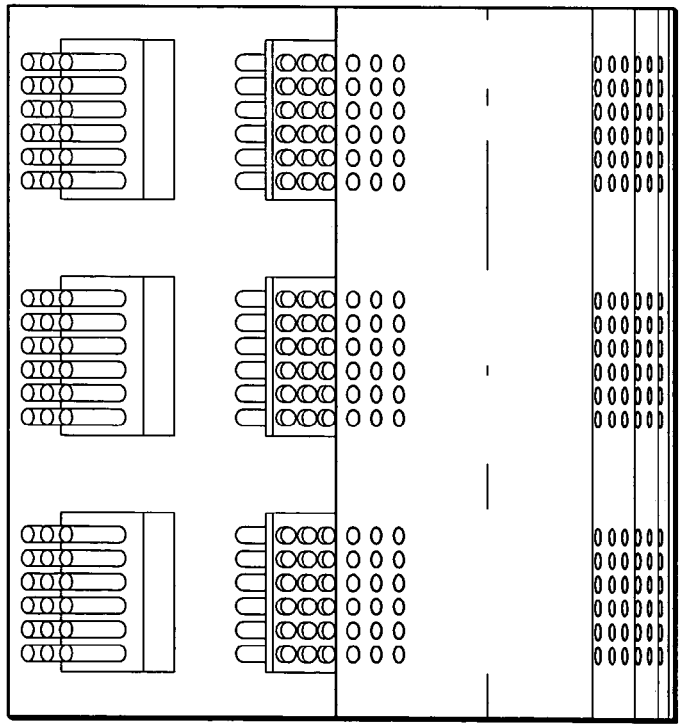

FIG. 7*b* illustrates the top view of an insulated conductive layer coupled to a packaged integrated memory chip. The dead space that exists between individual memory chips is also visible. These "dead spaces", do not contain any printing elements. By staggering the chip locations between two or more cylinders, it is possible to eliminate all dead space and evenly provide memory locations to print continuously in a linear fashion.

Figure 8A:
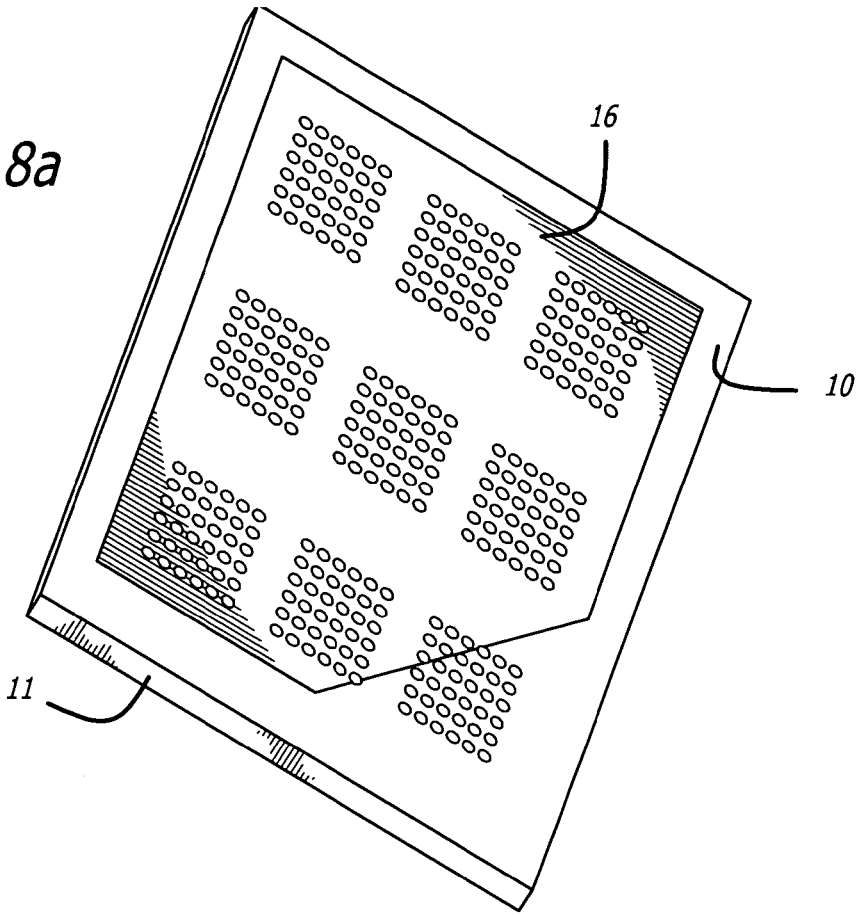
FIGS. 8*a*–8*b* show an insulated conductive layer in a flat geometric configuration.
Figure 8B:
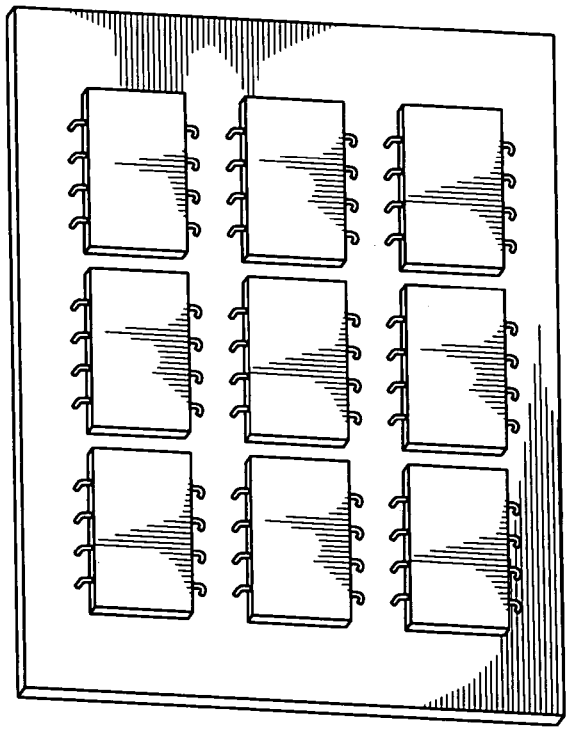

FIGS. 8*a*–8*b* show an insulated conductive layer in a flat geometric configuration. In FIG. 8*a*, the top surface is shown, and in FIG. 8*a* the bottom surface is shown. The integrated memory chip is attached to the bottom surface using different methods. One method is to use an asymmetrically conductive adhesive to bond the chip to the conductive micro-vias.

In FIGS. 1*a* through 6, the top surface generally represents the surface that will attract the ink. The bottom surface is generally where the memory chips or memory circuits are attached . The insulating layer isolates and provides mechanical isolation and electrical isolation between the chips and the ink receiving layers.

In both the packaged integrated memory chip and the flexible memory chip, the functionality of the memory elements is the same. The individual memory cells carry a voltage, and the voltage, when coupled to the conductive pads, is capable of attracting charged toner. What the memory circuits help avoid is the need to wire each conductive pad individually by an independent wire, which carries a voltage through it.

Using an asymmetrically conductive adhesive layer (ACA) is just one way to couple the insulated conductive layer to the memory cells. Other means can be used to couple the insulated conductive layer to the memory cells.

The memory structures identified in the preceding paragraphs, i.e. flexible and non-flexible, are some of the many possible configurations which spatially map an image stored in computer memory to a physical printing conductive point.

Is it also contemplated that digital printing elements using non-silicon based memory may be used. For example, in another embodiment of the present invention, a new method using organic semiconductor polymers to form memory is composed of a grid of intersecting electrodes which sandwich a polymeric layer can be used in the digital printing element construction. The intersection between the word (horizontal electrodes) and the bit lines (vertical electrodes) in these cases forms the point that connects to the physical printing conductive point. FIG. 9*a* shows one such potential structure, in a flat format. This is based on memory developed by Thinfilms, Inc. of Sweden. FIG. 9*b* shows an enlarged view of the structure described in FIG. 9*a*. This memory structure overlaid on the insulated conductive layer is also possible in a cylindrical configuration.

Details of Individual Memory Elements

Figure 11A:
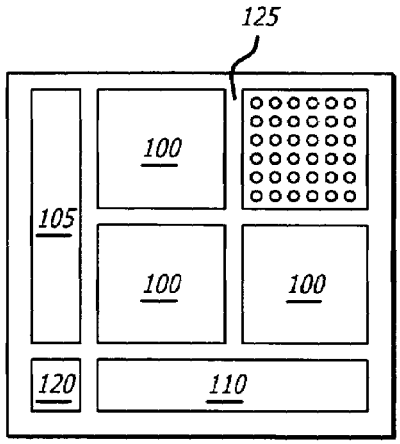
FIG. 11*a* is a block diagram of an exemplary semiconductor memory.

FIG. 11*a* is a block diagram of an exemplary semiconductor memory, which can be on a single integrated chip (IC). The address bus is used to access each memory location. Since the address is specified using a binary code, the number of connections to the chip needed to access many locations is $\log_2$ (n) where n is the number of memory locations. For example, for a standard 8'5" by 11" page at 300 dpi, which has 8,415,000 print locations, only 24 address bits are required to access all locations.

The integrated chip has row (105) and column (110) decoding circuits, along with global decoding and timing circuits (120). The storage locations are grouped in arrays (100), with channels (125) in between the arrays. The channels carry power, ground, and un-decoded or partially decoded address lines and other signals.

Figure 12A:
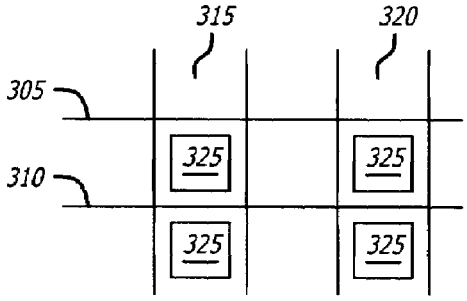
FIGS. 12*a*–12*b* illustrate various embodiments of how individual memory cells may be laid out.
Figure 12B:
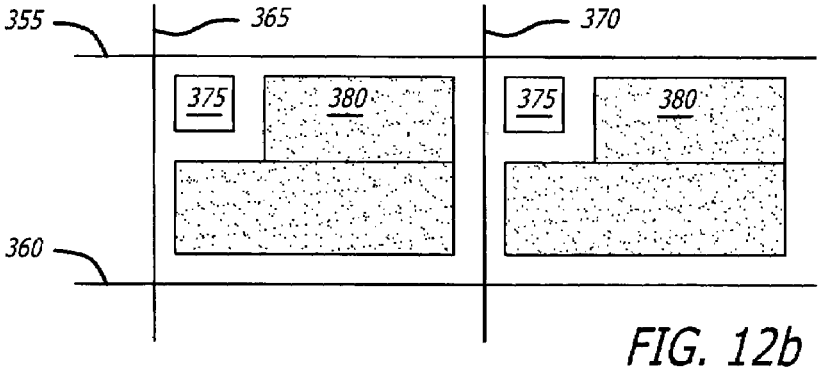

In a typical semiconductor memory, there is an array of storage elements 100 surrounded by peripheral circuitry. The array of storage elements, typically in the middle, is made up of areas of storage elements with areas in between which contain channels for power, ground and other signals. FIGS. 12*a* and 12*b* illustrate an exemplary single storage location in the memory.

Unlike a typical semiconductor memory, in which each element is designed to be as small as possible in order to increase density, these elements can be larger. This is because the pitch required for printing is much larger than the pitch achievable by semiconductor memories. A 300 dpi (dots per inch) image requires a dot pitch of approximately 85 micrometers (um), which is much larger than the pitch of storage elements or memory cells in a memory made in a modern semiconductor process. As a result, the pitch of the conductive elements at the surface is coarse, while the pitch at which the transistor elements, which form the memory in the semiconductor substrate, is fine. The transistor elements can therefore be larger, which makes them more robust and increases reliability and manufacturing yield. Furthermore the unused spacing can be used to perform local decoding which increases the uniformity of the memory array by moving some of the peripheral circuitry within the array itself, and also by making room for power, ground, and signal channels in between the elements.

Figure 11B:
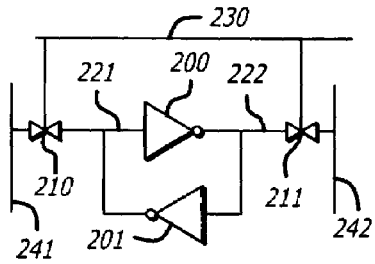
FIGS. 11*b*–11*c* show one storage location of the memory.

FIG. 11*b* is a storage element used in a semiconductor memory. This element is generally optimized to be as small as possible in order to maximize the storage density. FIG. 11*b* shows a diagram of a typical 6-transistor static memory (SRAM) cell. Inverters 200 and 201 are cross-coupled and connected to bit lines 241 and 241 via access gates 210 and 211. The nodes 221 and 222 at the outputs of the inverters are the charge storage nodes. The access gates are driven by the word line 230. In a typical semiconductor memory used for mass storage, the access gates 210 and 211 are usually single NMOS transistors.

In the digital printing element application, since area density is allowed to be less, the access gates 210 and 211 may be transmission gates rather than single NMOS transistors, which can improve noise immunity and cell robustness.

Figure 11C:
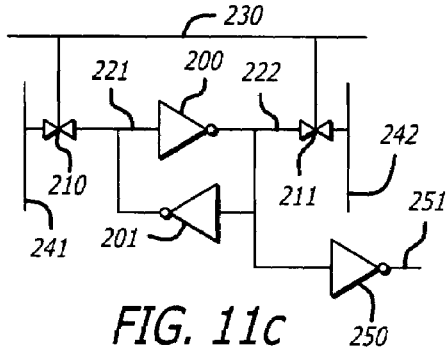

In FIG. 11*c*, the charge stored on a typical SRAM storage node (221 and 222) is small and so the node cannot be connected directly to the printing surface. In order to decouple the storage node from the printing surface, an additional inverter 250 is used to isolate the storage node 222 from the printing surface. The output 251 of the inverter 250 is coupled using the metal via to the printing surface.

FIGS. 12*a*–12*b* shows how the relaxed pitch can be used to make the array more uniform; FIG. 12*a* shows the layout of a conventional semiconductor memory. The array consists of a grid of word lines (305 and 310) and bit line pairs (315, 320). Memory cells 325 are placed at the intersections of the word lines and bit line pairs. Since the aim is to maximize storage by optimizing density, the cells are made as small as possible and packed as close to each other as possible. Therefore, the spacing between word lines 305 & 310 is minimized, as is the spacing between the bit line pairs 315 & 320, and these are generally just as much as is needed to fit the storage cell at the intersection. So, all decoding circuits which decode the incoming address to provide signals for the word and bit lines are placed at the periphery of the array, as shown in FIG. 11*a*.

FIG. 12*b* illustrates an embodiment whereby the decoding circuits are located with each memory cell, as opposed to outside of the array of memory cells. FIG. 12*b* shows how wires and decoding circuits can be interspersed with the storage elements of the array when the pitch is relaxed. Since the digital printing element does not have to be as densely packed as a semiconductor memory and does not have to operate as fast as a conventional memory, two modifications can be made. One, the cell (375) can be made single ended (i.e. it can use only one bit line (365, 370) instead of a pair of complementary bit lines), and two, the spacing between word lines (355, 360) and bit lines (365, 370) can be larger than in a conventional memory. Therefore additional decoding and buffering circuits 380 can be placed in the area available at the word and bit line intersections, in order to reduce the non-uniformity caused by having to place all the decoding circuits at the edges of the array.

One example of a single ended storage cell is shown in the circuit of a conventional master slave latch shown in FIG. 13. Many such circuits are known to those well versed in the art and can be used for this purpose.

FIG. 14 is a cross sectional view of a semiconductor layout and shows how a micro-via may be used to connect the transistors of a memory element to the surface of the chip to drive a print element. FIG. 14 shows the typical via structure used to connect the transistors to the printing surface. Transistors 410 and 420 are shown in a silicon wafer 415. The p-type transistor 420 is shown in an n-well 425, as is typical in CMOS technology. The transistor 420 has a source 431 and a drain 432 and a gate 433. The source 431 is connected via the metal contact and metal layer 441 as appropriate for the circuit (details not shown here).

The n-type transistor is constructed directly in the substrate 415 and has a source 411 and a drain 412 and a gate 413. The source 411 is connected as appropriate using a contact and metal layer 442. The two transistors are connected using contacts and metal layer 443. A dielectric layer 450 insulates metal layer 1 (441 and 442) from higher metal layers. A via and metal 2 layer 460 are used to connect down to metal layer 1 and the connection between transistors 410 and 420. Other connections (not shown) may also exist on this metal layer. There may be more metal layers (layer 3, layer 4) etc as required by the technology used to fabricate the circuit. Finally, a via 475 is used to connect the highest layer to the surface 480 of the chip. Dielectric layers 470, 465, etc are used to insulate the circuit at the lower levels from the surface. The topmost via 475 is finally connected to the printing surface using various means as discussed elsewhere in the document.

As is well known to those well versed in the art, this is a very typical configuration of transistors used to construct circuits in silicon. With reference to FIG. 11*c*, the transistors 410 and 420 together constitute the inverter 250, and the output 251 of the inverter is formed by the contact and metal layer 443 in FIG. 14. The other transistors used to form the memory cell are not shown, but their formation and connection is similar and can be understood by a person well versed in the art.

The yield of semiconductor chips reduces as their area increases. Therefore, it is not practical to make a single memory chip that covers the area of an entire page, but it is necessary to use many chips to cover an entire page or image area. FIG. 15 shows how an array of chips 500 can be connected to create a large array. In order to maintain a simple and efficient communication channel to the entire array, a communication bus scheme is proposed in which a bus 500/505 is used to connect all the chips 500. An arbitration and communication protocol will be used to allow each chip to be loaded with its portion of the image. Since image loading time is not a constraint in this application, it is possible to optimize the protocol for ease of communication and low wire-count by using a low bandwidth protocol.

Busses 500 and 505 are used to connect the cells. These busses carry address, data, power, ground, and other signals, and are designed to reduce the wiring needed between the chips.

Figure 16:
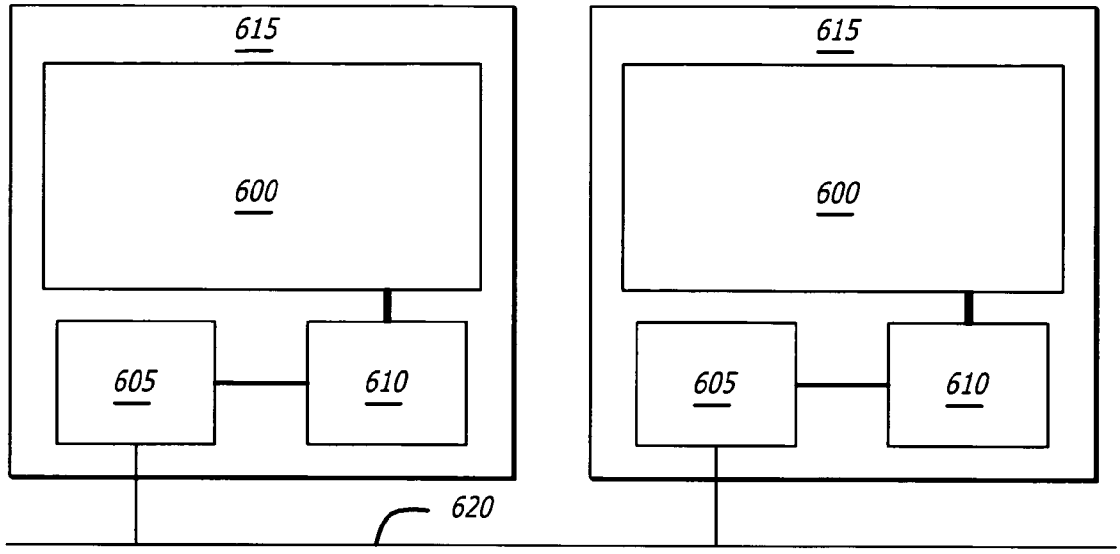
FIG. 16 is a block diagram of how each chip can be designed to have an interface element.

FIG. 16 is a block diagram of how each chip can be designed to have an interface element that handles the protocol, coupled with the image storage function described earlier.

The digital printing element array 600 is connected to conventional decoding circuits 610 that may be used in one chip. A communications controller 605 listens to the narrow bus 620 that connects the chips in an array. Communications controller 605 listens to the protocol on the bus 620 and recreates address and data information for the chip, which it passes to the decoding circuit 610 along a bus which is wider than 620. In turn, the decoding circuit 610 finishes the decoding and drives the array 600 along a bus of appropriate (as much as needed) width, as shown in the diagram.

Figure 17:
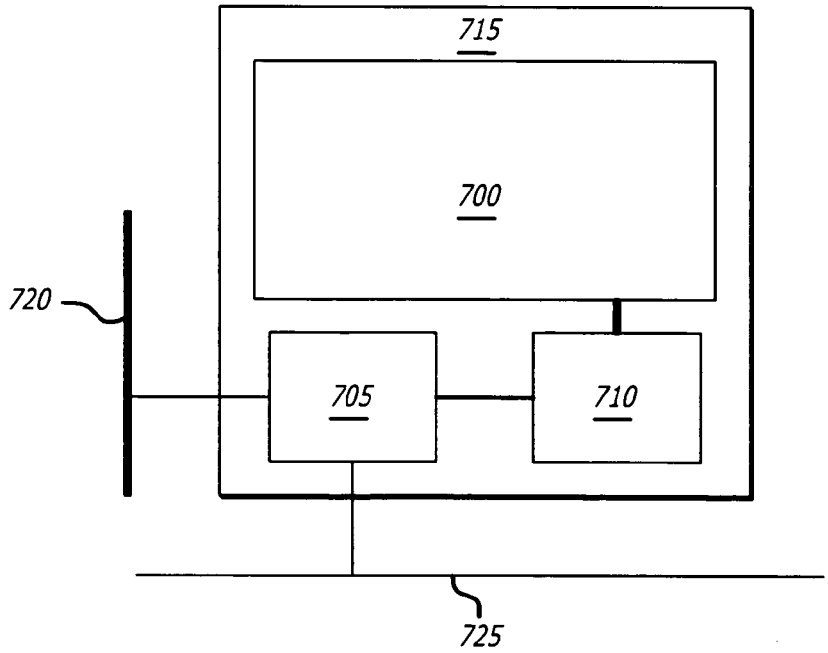
FIG. 17 illustrates an embodiment wherein each chip has a wireless link.

In order to reduce the number of wires and therefore increase ease and reliability, a low-bandwidth wireless link can be built into each array as shown in FIG. 17. Thus each array can be made into a sealed module with a unique address and only power and ground connections made externally. This can be used to control access to each module, and provide tracking and access control by including encryption and authentication in the communication protocol. In place of a wireless link, it is also possible to use some other physical connection that is made temporarily to download the image into the module, after which the connection is broken.

In addition to being a protocol engine as shown in FIG. 16, the block 705 can be a wireless communications processor, which uses an antenna 720 as its input bus for data, address, and other information. The antenna 720 can be built on to the chip 715, or can be an external metal trace that is connected to the chip. In this case, the bus 725 would only carry power and ground to the chips 715 in an array.

Working of the Print Engine

The print engine is composed of the semiconductor memory layer overlaid on the insulated conductive layer with a one to one correspondence of each memory cell with the conductive pad on the insulated layer. This combination of the memory cell with a conductive location is called a digital printing element. Once the overlaying of the memory cell with the conductive element is accomplished, then the entire structure can be fashioned into a either a planar structure or a cylindrical structure with the insulated conductive pads providing protection to the sensitive semiconductor memory from impact loading that occurs during the printing process.

As pointed out earlier, the memory storage array is not contiguous even within a chip. When an array of chips is put together, there will be spaces (dead space) between the image element arrays due to the peripheral circuitry on each chip as well as the edge space required on each chip in which active circuitry cannot be placed. Therefore we propose a scheme of using two consecutive elements, in two cylinders or two plates, in which the stored memory arrays are spatially overlapped such that the print locations of one cover the areas of the other in which print locations are absent. This will give continuous coverage of the printing surface by print locations. This scheme will also provide a built-in redundancy mechanism by which failed print locations on one cylinder or surface can be compensated by a corresponding location on the other surface. This scheme can be extended to more than two surfaces in order to improve coverage and reduce the impact of failed print locations on any one surface.

The image to be printed is first stored in a computer as a binary bit pattern, physically corresponding to a 1 or a 0 depending upon the presence or absence of a dot. From the computer, the memory can be directly downloaded to the memory location on a bit by bit basis, corresponding to the pixel value of the image stored. Thus there is a spatial map of the data corresponding to the image and the physical memory cell location. See FIG. 11*a* for a pictorial representation of the memory map. Thus each memory cell location will contain a digitally stored "1" or a "0" depending on whether the pixel in the original image is turned on or off.

Because the print image is stored electronically and there is an electronic map of how each image digital printing element maps on to a physical location, the print image can be aligned very easily by adjusting the specific locations in which individual image bits are stored. Physical alignment of the paper to the cylinder is not needed, and alignment can be done electronically by shifting or rotating the image, as it is stored in the print array. This problem overcomes alignment and registration of images and colors that are found in traditional lithography based printing presses.

By adding a scanner to the output of the printer, it is also possible to align the print elements. An image or images with a fixed pattern can be printed and then scanned. The scanned output can be examined either manually or using computer algorithms which can detect registration errors between the multiple print cylinders, and the images stored in the cylinders can be adjusted until the final image is free from registration errors. This process can be either fully automatic, or may be used to minimize the amount of human intervention required to align the images.

Figure 18A:
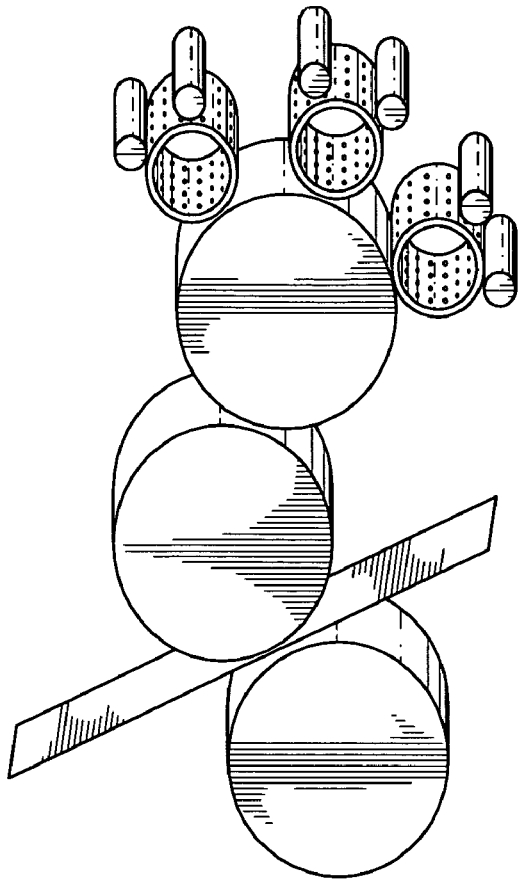
FIGS. 18*a*–18*b* illustrate an exemplary embodiment of a printing system.
Figure 18B:
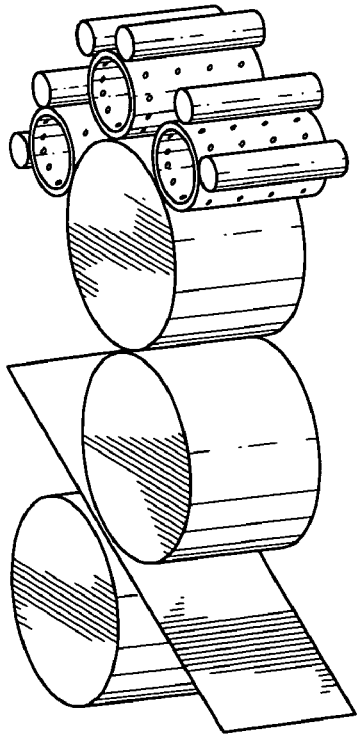

FIG. 18*a* shows how the print engine can be configured with an offset cylinder and inking cylinders to transfer charged ink from a source to the final medium (Paper or plastic or metal) in sheet or continuous web form. For sake of clarity, the electrical connections, and mechanical support structures have been omitted. The ink is transferred from the inking cylinders via electrostatic attraction to the print engine. The ink cylinder will carry a charge that is opposite to the charge carried by the locations on the print engine, which have a digitally stored charge on them. Thus the toner ink will have the same charge as the ink cylinder. This causes the ink to travel from the surface of the ink cylinder to the surface of the print engine, which has an opposite polarity of charge at the locations corresponding to the stored image. A multitude of print engines (3) are shown, as the image to be printed has to be spatialized without any dead space. From the print engine, the ink, which is only attracted to locations that have the pixels turned on the entire digitally stored image, is transferred to the offset cylinder. This offset image is transferred to the upper transport cylinder and from there it will be transferred finally to the printing medium. This process goes on continuously, until all the ink is depleted or the image is changed. FIG. 18*a* shows a perspective view from a different viewing angle with more details of the internal structure of the print engine. FIG. 18*b* shows another perspective viewing angle of the print engine and the associated components. In this perspective viewing angle the contact pads on the print engine are also visible.

In FIGS. 18*a*–18*b* the inking cylinders can all carry black ink, in which case the printer will be configured to print in monochrome. To print in color, four stations, each identical to the one configured in FIG. 18*a* can be arranged in series such that the medium such as paper or plastic or metal can successively pass through each station and acquire the component of color from each station. A subtractive color printing scheme employing cyan, magenta yellow and black colors could be used in each of the stations respectively to generate the composite color density required by the final image. A software based color separation scheme that will separate the color pixels from each image to be printed will be used to download the pixels into each of the print engines. In addition to the subtractive colors and black, additional colors can also be used for highlighting and other glossy effects. An extra print engine configuration in series with the four colors would be necessary in such a situation.

Figure 19A:
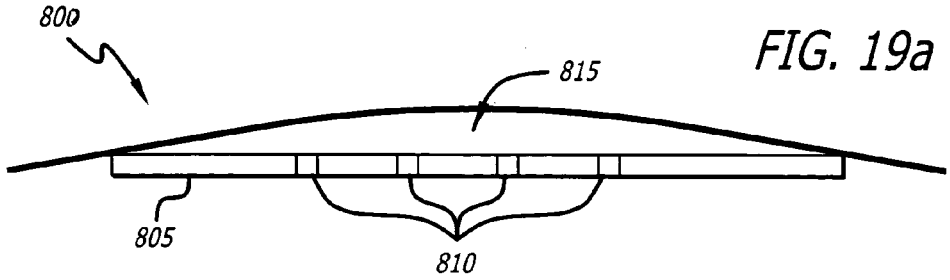
FIGS. 19*a*–19*b* illustrate methods of adapting a traditionally flat chip onto a curved printing surface.
Figure 19B:
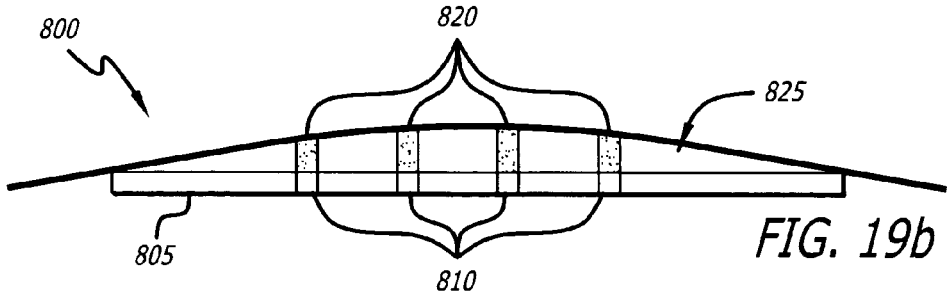

In FIG. 19*a,* some methods of adapting the flat integrated chip 805 to a curved printing surface 800 are shown. The chip has vias 810 that are connected to the storage elements and bring the stored voltage to the surface as discussed earlier. In FIG. 19*a,* a directionally conductive adhesive 815 is used to connect the vias at the chip surface to the curved printing surface. This adhesive serves as a vertical connection as well as a strain relief layer. FIG. 19*b* shows a grid of columns 820 which are used to connect the chip surface to the printing layer. These columns are typically made of metal, though other materials may be used. An insulating material 825 can be used to fill in the gaps between the columns, and this material also acts as a support and strain relief layer.

Figure 20:
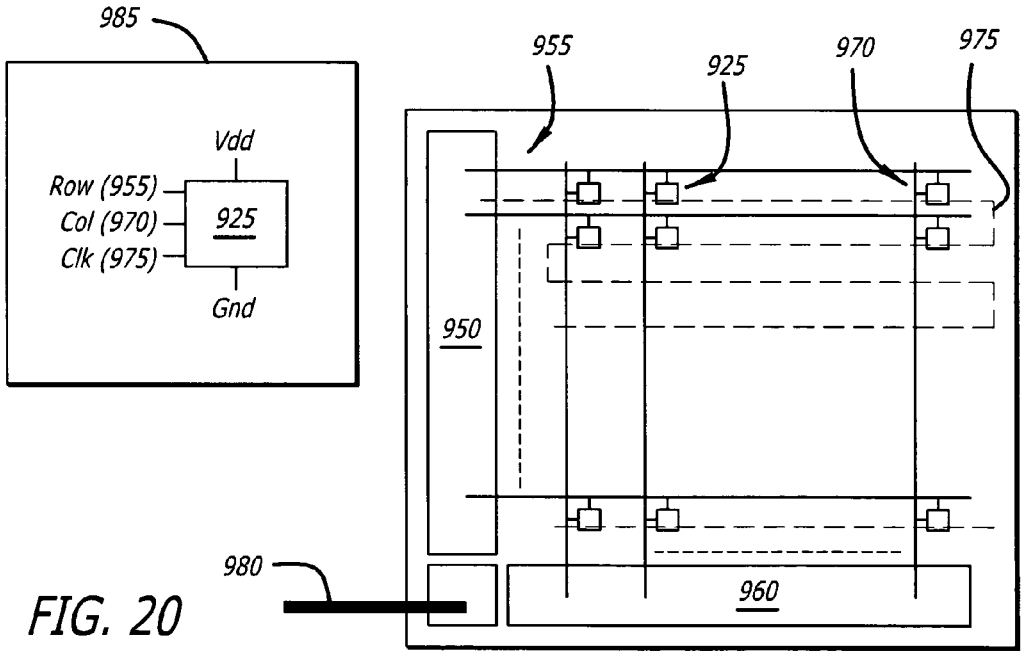
FIG. 20 shows how a single-ended, thin film print element can be used.

FIG. 20 shows how a single-ended, larger-area thin-film print element 925 can be used. The inset shows the element 925, which takes in decoded row and column signals, a clock signal, and Vdd and ground. The arrangement of these elements into an array is also shown, and is similar to the conventional memory layout. The grid consists of coarse row and column decoding circuits 950 and 960, which decode the incoming addresses into rows (955) and columns (970): In addition, a global clock connection 975 is sent to all the storage elements 925. The storage elements 925 are placed at the intersection of the decoded row and column lines, and additional decoding circuits may also be placed there as discussed earlier. The address and data information for the chip is brought in on a bus 980.

FIG. 13 shows the circuit of a conventional latch circuit, which is traditionally used in IC design. It consists of a transmission gate 905, an inverter 910, a clocked inverter 915, and these are connected to form a storage element. Such an element may be more easily created using thin-film-transistor technology, since it is more robust because it can be made using larger transistors.

Figure 21:
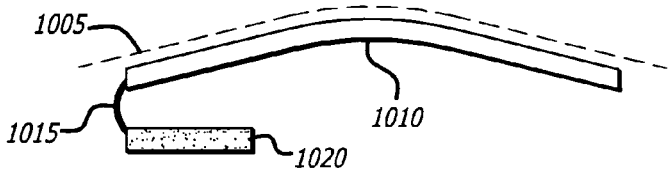
FIG. 21 shows the connection of a storage array to a thin film substrate.

FIG. 21 shows the connection of a storage array on a thin-film substrate 1010 to a conventional silicon chip 1020 using a flexible bus 1015. The flexible thin-film substrate can be made conformal to the printing surface 1005. A printing system and method is described in which an image, such as a barcode or conductor pattern, are stored in an electronic memory that stores each dot that makes up the stored image as a first or second state. The electronic memory locations corresponding to each dot of the image to be printed are electrically coupled to one or more digital printing elements and have a state that corresponds to the state of the memory location coupled thereto. To provide for proper printing, a charged ink is used that is attracted to the first state and is not attracted by the second state. Accordingly, ink will accumulate at the digital printing elements that are of the first state and little or no ink will accumulate at digital printing elements that are of the second state.

The charged ink, which is also referred to as smart ink, has an electrical charge that responds to a difference in voltage potential by being attracted to and accumulating at one potential and by not being attracted to a second potential. These charged inks may be black or may contain a pigment. For example, in the case of color printing typically a subtractive color scheme is used in which four separate charged inks would be used that respectively have pigments of cyan, magenta, yellow, and black. Although this is a typical color printing scheme, the printing system and method described herein is not limited to a subtractive color scheme and may be used with any color scheme.

Typically, a charged ink has a positive charge and will therefore be attracted to the points have the lowest potential. For example, if a first state were 2 volts and the second were a more positive voltage, the positively charged ink would be attracted to the 2-volt sites and not attracted to the more positive voltage. Likewise, if a first state were a voltage of −3 volts and the second state were a voltage of 0 volts or ground, the positively charged ink would be attracted to the −2 volt sites. The positively charged ink may contain any desired pigments to form a desired color.

Similarly, although not as common at this time, a negatively charged ink will be attracted to sites having the highest potential. For example, if a first state were 2 volts and the second were a more positive voltage, the negatively charged ink would be attracted to the more positive voltage sites and not attracted to the 2 volt sites. Likewise, if a first state were a voltage of −3 volts and the second state were a voltage of 0 volts or ground, the negatively charged ink would be attracted to the 0 volt sites and not attracted to the −3 volt sites. The negatively charged ink may contain any desired pigments to form a desired color.

Figure 22:
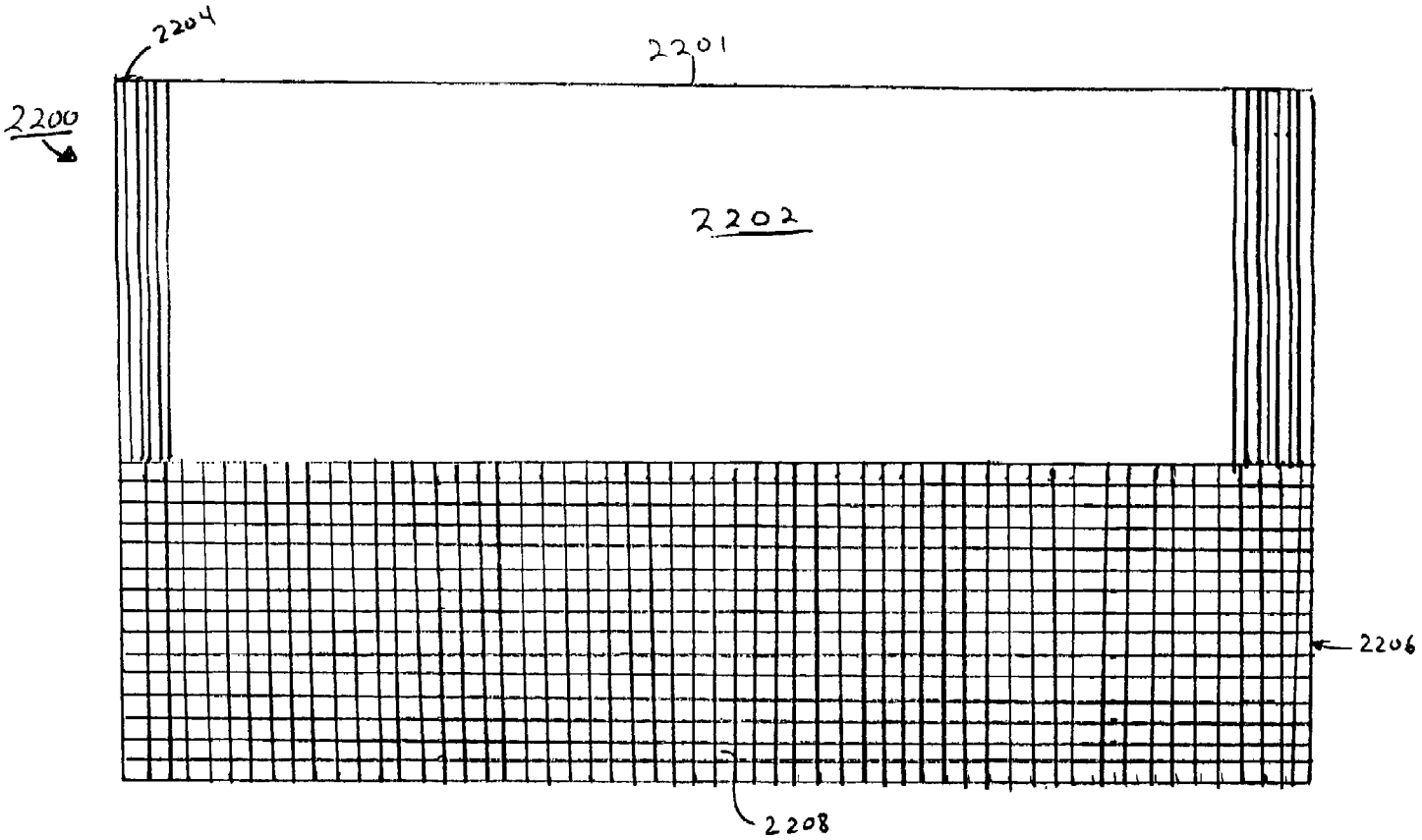
FIG. 22 depicts a plan view of a top surface of a print engine suitable for use with the printing method and system described herein.

FIG. 22 depicts the top surface of a print engine that is compatible with the printing system and method described herein. In particular, a print engine 2200 has a top surface 2201 that includes a first area 2202 and a second area 2206. The first area 2202 may include a plurality of line elements 2204 extending across the top surface 2201 of the print engine 2200. The line elements 2204 are typically conductors and are sized and spaced depending upon the application. For example, if the print engine 2200 is to be used to print linear bar codes, the width and spacing of the individual line elements may be, without limitation, 10 μm. The spacing is selected such that two adjacent line elements may be spaced to form a thicker line when both line elements have the first state. Similarly, spacing between two adjacent line elements may be selected to allow for a space between two adjacent line elements even when both are attracting charged ink.

The print engine 2200 is constructed on an insulating substrate that may be rigid or flexible depending upon the application. For example a curved substrate would allow the substrate to be wrapped around a cylindrically shaped object. In this embodiment a system of rollers may be used to transfer the charged ink to the print engine 2200. A rigid substrate would allow the substrate to be mounted on a flat surface or panel for the final application with the charged ink transferred to and from the flat panel to a printing medium.

Figure 23:
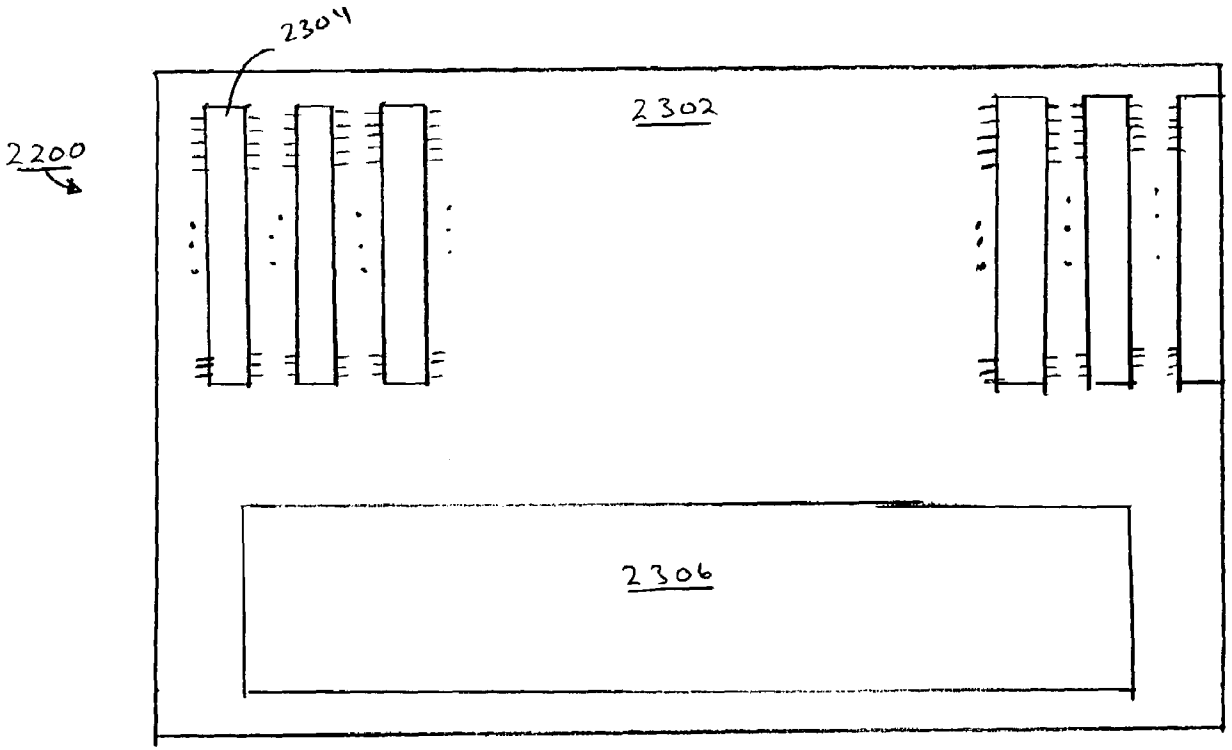
FIG. 23 depicts a plan view of a bottom surface of a print engine suitable for use with the printing method and system described herein.

FIG. 23 depicts a bottom surface of a print engine that is compatible with the printing system and method described herein. In particular, the print engine 2200 includes a bottom surface 2302 on which line chips 2304 are used to drive one or more line elements 2204 on the top surface of the print engine 2200. For a given bar code. A printel grid chip 2306 is contains memory that is coupled to the individual printel cells 2208 to provide the appropriate state to them.

In one embodiment the printed image may be a linear barcode that includes a plurality of parallel lines of varying thicknesses and spacing and one or more symbols printed beneath the plurality of parallel lines. In this embodiment, the lines that need to be inked are computed and this data is translated to specific the memory locations that are then coupled to the individual line elements. The printel cells 2208 that are to be used to print the desired symbols are determined and data is written to the memory locations corresponding to these printel cells. In this embodiment, the memory locations for the various line elements are contained in the plurality of line chips 2304 and the memory locations for the printel cells are contained in the printel grid chip 2306. It is therefore possible to load an image into the plurality of line chips 2304 and the printel grid chip 2308 over a bus or communication channel (not shown). Once the image is loaded into the various memory lcoations, the line elements and the printel cells associated with each memory location receive the appropriate state, i.e., voltage, and the image can be formed on any printing media. After a desired number of images have been printed, a new image can be downloaded and a new image can be printed In another embodiment, the printed image may be a 2-dimensional barcode image. In this embodiment, the first area 2202 and the second area 2206 are co-located between two or more line elements. The printel cells 2208 are not used to display symbols as in the linear bar code embodiment, but rather are individually coded to display a predetermined 2-dimensional barcode matrix of two or more different colors.

Figure 24:
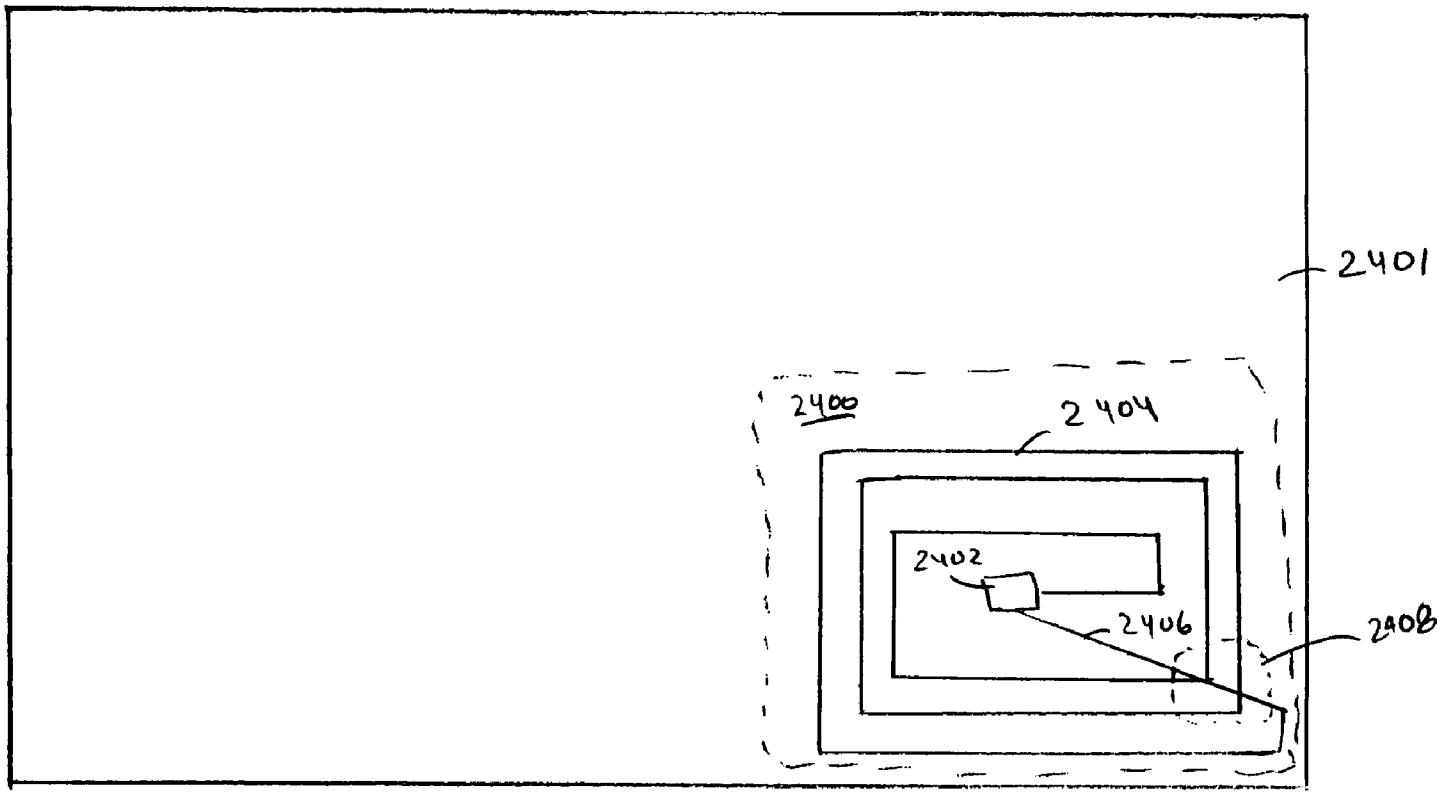
FIG. 24 depicts an RFID tag antenna that can be printed using the printing method and system described herein.

In another embodiment, the pattern of line elements is not a parallel series of lines as in a barcode, but rather is a pattern of one or more continuous traces that may or may not be interconnected and that may be used to form electrical circuits, antenna, or other electrical structures. In an embodiment in which the various line elements form an antenna, the line elements are continuous with one another and are coupled to an appropriate electrical circuit. For example, as depicted in FIG. 24 an RFID tag 2400 is formed on substrate 2401. The RFID tag includes an integrated circuit 2402 coupled to an antenna 2404 via an antenna connection 2406. In this embodiment, the antenna 2404 and the antenna connection 2406 are printed as described above using line elements or printel cells to form the necessary traces on the substrate 2401. In the case of the cross-over section 2408, multiple printing with conductive and non-conductive inks may be used to properly layer the various electrical traces to avoid a short circuit. In this embodiment, the charged ink that is used to make the electrical traces is an electrically conducting ink and provides the necessary conductive path when printed onto the substrate. Electrical circuits other than antenna may be formed using by the printing system and method described herein when using electrically conductive ink. Rapid prototyping of electrical circuit and flexible manufacturing of electrical circuits may be achieved using the printing system and method described herein.

In another embodiment, an electrical integrated circuit may be formed using semiconductor inks, non-conductive inks, and, if necessary, conductive inks to form the various semiconductor elements. In this embodiment, the various layers can be built up using the various inks to achieve a multi-layered structure similar in structure, if not in size, to traditional integrated circuits.

While the printing system has been described in detail and with reference to specific embodiments thereof, it will be apparent to those skilled in the art that various changes and modifications can be made therein without departing from the spirit and scope thereof. Thus, it is intended that the appended claims, and their equivalents, define the invention.

We claim:

1. A print engine for printing using a charged ink, the print engine comprising:

a print element including at least one conductive element which is electrically coupled via a buffer amplifier to a memory circuit that can switch between at least a first state and a second state, wherein the conductive element has a state that corresponds to the associated memory circuit, and wherein when in the first state the conductive element attracts the charged ink and when in the second state the conductive element repels the charged ink.

2. The print engine of claim 1, wherein the printing element includes a plurality of printing elements each including at least one conductive element, the plurality of printing elements disposed in a predetermined print pattern, wherein the at least one conductive element of each printing element is coupled to an individual memory circuit, wherein each of the at least one conductive elements of each printing element has the same state as the corresponding individual memory circuit.

3. The print engine of claim 2, wherein the print pattern includes the plurality of printing elements formed into a plurality of substantially parallel lines, wherein each printing element may be individually controlled by the corresponding individual memory circuit, wherein a pattern of parallel lines and spaces is formed.

4. The print engine of claim 3, wherein the patterns of parallel lines and spaces are configured to form a barcode.

5. The print engine of claim 4, wherein the bar code is a linear barcode.

6. The print engine of claim 3, further comprising a plurality of printel cells, wherein each printel cell includes a conductive element, the conductive element being coupled to a memory circuit that can switch between at least a first state and a second state, wherein the conductive element of each printel cell has a state that corresponds to the associated memory circuit, and wherein when in the first state the printel cell attracts the charged ink and when in the second state the printel cell repels the charged ink.

7. The print engine of claim 6, wherein the plurality of printel cells are arranged in a grid pattern, wherein the states of each of the conductive elements of the printel cells may be individually configured.

8. The print engine of claim 7, wherein the states of the printel cells may be configured to form alphanumeric symbols.

9. The print engine of claim 7, wherein the states of the printel cells may be configured to form a 2-dimensional bar code.

10. The print engine of claim 7, wherein the plurality of printel cells arranged in a grid pattern are disposed under the print pattern to form a barcode.

11. The print engine of claim 7, wherein the plurality of printel cells arranged in a grid pattern are disposed between two or more of the printing elements formed into a plurality of substantially parallel lines.

12. The print engine of claim 3, wherein the unique memory circuit is contained on a memory chip.

13. The print engine of claim 3, further including a row decoder having one or more inputs operable to receive an input signal and at least one output coupled to at least one of the plurality of substantially parallel lines, wherein the row decoder is operative to select one or more of the parallel lines as a function of one or more received input signals.

14. The print engine of claim 13, further including a column decoder having one or more inputs operable to receive an input signal and at least one output coupled to at least one of the plurality of substantially parallel lines, wherein the row decoder is operative to select one or more of the parallel lines as a function of one or more received input signals.

15. The print engine of claim 14, wherein the plurality of input signals comprise together a row address formed in series.

16. The print engine of claim 14, wherein the plurality of input signals comprise together a row address formed according to a predetermined communications protocol.

17. The print engine of claim 16, wherein the plurality of input signals comprise together a column address formed in parallel.

18. The print engine of claim 14, wherein the one or more inputs include a plurality of inputs, each of the plurality of inputs operable to received one or more input signals.

19. The print engine of claim 14, wherein the plurality of input signals comprise together a column address formed according to a predetermined communications protocol.

20. The print engine of claim 13, wherein the one or more inputs include a plurality of inputs, each of the plurality of inputs operable to received one or more input signals.

21. The print engine of claim 20, wherein the plurality of input signals comprise together a row address formed in parallel.

22. The print engine of claim 20, wherein the plurality of input signals comprise together a column address formed in series.

23. The print engine of claim 1, wherein the at least one conductive element includes a conductor disposed upon an insulating substrate.

24. The print engine of claim 23, wherein the conductor is a metallic conductor.

25. The print engine of claim 24, wherein the metallic conductor is selected from the group consisting of gold, silver, copper, aluminum.

26. The print engine of claim 1, wherein the at least one conductive element is a semiconductor.

27. The print engine of claim 1, wherein the charged ink is electrically nonconductive.

28. The print engine of claim 1, wherein the charged ink is electrically conductive.

29. The print engine of claim 1, wherein the charged ink is an electrical semiconductor.

30. The print engine of claim 1, wherein the at least one conductive element of the print element is configured in a predetermined continuous pattern.

31. The print engine of claim 30, wherein the predetermined continuous pattern includes an antenna pattern including an interconnect portion.

32. The print engine of claim 31, wherein the charged ink is electrically conductive ink.

33. The print engine of claim 32, wherein the charged ink is electrically a semiconductor.

34. The print engine of claim 1, wherein the charged ink is positively charged and wherein the first state is at a lower potential than the second state.

35. The print engine of claim 1, wherein the charged ink is a negatively charged ink and wherein the first state is at a higher potential than the second state.

36. The print engine of claim 1, wherein the charged ink contains a pigment of a desired color.

37. The print engine of claim 36 wherein the desired color is black.

38. The print engine of claim 36 where the desired color is part of a color scheme.

* * * * *